US010658776B2

(12) United States Patent
Aimoto

(10) Patent No.: US 10,658,776 B2
(45) **Date of Patent: *May 19, 2020**

(54) RIGHT-ANGLE ELECTRICAL CONNECTOR

(71) Applicant: Hirose Electric Co., Ltd., Shinagawa-ku, Tokyo (JP)

(72) Inventor: Daiki Aimoto, Tokyo (JP)

(73) Assignee: HIROSE ELECTRIC CO., LTD, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/445,112

(22) Filed: Jun. 18, 2019

(65) Prior Publication Data

US 2020/0006877 A1 Jan. 2, 2020

(30) Foreign Application Priority Data

Jun. 21, 2018 (JP) ..... 2018-118041

(51) Int. Cl.

| | |
|---|---|
| ***H01R 13/40*** | (2006.01) |
| ***H01R 12/72*** | (2011.01) |
| ***H01R 13/41*** | (2006.01) |
| ***H01R 12/57*** | (2011.01) |

(52) U.S. Cl.

CPC ..... *H01R 12/724* (2013.01); *H01R 12/57* (2013.01); *H01R 12/727* (2013.01); *H01R 13/41* (2013.01)

(58) Field of Classification Search

CPC ..... H01R 13/4223; H01R 13/4635; H01R 103/00; H01R 13/41; H01R 13/6215

USPC ..... 439/752.5, 595, 362–364, 594, 598, 733

See application file for complete search history.

(56) References Cited

U.S. PATENT DOCUMENTS

| | | | | |
|---|---|---|---|---|
| 9,130,315 | B2 * | 9/2015 | O'Malley | H01R 13/6469 |
| 9,188,752 | B2 * | 11/2015 | Nong Chou | G02B 6/4266 |
| 9,345,128 | B2 * | 5/2016 | Regnier | H01R 13/6469 |
| 9,354,404 | B2 * | 5/2016 | Ql | G02B 6/428 |

FOREIGN PATENT DOCUMENTS

JP 2016-207600 A 12/2016

* cited by examiner

*Primary Examiner* — Phuong Chi Thi Nguyen

(74) *Attorney, Agent, or Firm* — Procopio, Cory, Hargreaves & Savitch LLP

(57) ABSTRACT

Blades 20A to 20D are formed such that arm portions 31A to 31D of electroconductive elongated members 30A to 30D are retained in place with the help of insulating plates 50A-1 to 50D-2, a housing 10 has formed therein holding portions 17A to 17D allowing for the above-mentioned blades 20A to 20D to be inserted from the rear, said holding portions 17A to 17D have formed therein guiding portions 17A-1 to 17D-1 guiding the insertion of the above-mentioned blades 20A to 20D from the rear with the help of guiding grooves 17A-3 to 17D-3 extending in the forward-backward direction, and movement of the above-mentioned blades 20A to 20D in the up-down direction within the guiding grooves 17A-3 to 17D-3 is restricted.

7 Claims, 8 Drawing Sheets

(A)

(B)

(A)

(B)

RIGHT-ANGLE ELECTRICAL CONNECTOR

CROSS-REFERENCE TO RELATED APPLICATIONS

This application claims priority to Japanese Patent Application No. 2018-118041, filed Jun. 21, 2018, the contents of which are incorporated herein by reference.

BACKGROUND

Technical Field

The present invention relates to a right-angle electrical connector.

Related Art

Known right-angle electrical connectors include, for example, the connector of Patent Reference 1. The connector of Patent Reference 1 is disposed on a mounting face of a circuit board and has a counterpart connector inserted and extracted therefrom from the front in such a manner that a direction parallel to said mounting face (forward-backward direction) is the direction of insertion and extraction. In this manner, since the direction perpendicular to the mounting face of the circuit board and the above-mentioned direction of insertion and extraction are at right angles to each other, the connector of Patent Reference 1 is referred to as a right-angle electrical connector. Said connector may have multiple blades, for example, the hereinafter-described four types of blades, and a single housing that holds said blades.

The respective blades, which have multiple terminals, are formed as single blades due to the fact that the hereinafter-described arm-portion blades and leg-portion blades are coupled via bend portions provided in said terminals. In the terminals, which are in a horizontal L-shaped configuration as a whole, the above-mentioned arm portions extending in the forward-backward direction and leg portions extending in the up-down direction are respectively disposed on the major faces of the hereinafter-described arm-portion blades and leg-portion blades and are coupled via bend portions bent at a right angle. On the front end side of the above-mentioned arm portions, there are formed contact portions used for contacting a counterpart connector, and on the lower end side of the above-mentioned leg portions, there are formed connecting portions used for making solder connections to the above-mentioned mounting face. The above-mentioned arm-portion blades and the above-mentioned leg-portion blades are formed by collectively retaining in place the respective arm and leg portions of the plurality of terminals disposed in an array via integral molding with the help of separate insulating plates made of plastic. In addition, in the above-mentioned four types of blades, the arm and leg portions of the respective blades of different types are set to different lengths such that the above-mentioned arm portions are positioned so as to be successively spaced apart from one another in the up-down direction and the above-mentioned leg portions are positioned in a similar manner in the forward-backward direction.

The above-mentioned housing has four tiers of holding portions used for holding various types of blades formed in the up-down direction in alignment with the respective blades. The respective holding portions, which are formed as passages in the forward-backward direction, are adapted to permit insertion of the arm-portion blades of the corresponding blades from the rear. The respective holding portions have front engagement pieces extending forward and rear engagement pieces extending backward from the interior wall surface of said holding portions. Said front engagement pieces and said rear engagement pieces have a cantilever configuration extending from the upper interior wall surface or lower interior wall surface of the above-mentioned holding portions and are capable of resilient displacement in the up-down direction.

Front engagement protrusions and rear engagement protrusions protruding from the major faces of the insulating plates are formed on the arm-portion blades of each blade at respective locations on the front end side and on the rear end side of said arm-portion blades. When the above-mentioned arm-portion blades are held within the above-mentioned holding portions, the above-mentioned front engagement pieces are positioned in a manner permitting engagement with the front engagement protrusions of the arm-portion blades from the rear, and the above-mentioned rear engagement pieces are positioned in a manner permitting engagement with the rear engagement protrusions of the arm-portion blades from the front, as a result of which blade movement in the forward-backward direction is restricted. In addition, the arm-portion blades, which are held in the above-mentioned holding portions with a predetermined amount of play in the up-down direction, are disposed so as to allow for movement in the up-down direction with a certain degree of freedom within said range of play. As a result, the arm-portion blades are permitted to assume an inclined orientation when viewed in the terminal array direction.

PRIOR ART LITERATURE

Patent References

Patent Reference 1

Japanese Published Patent Application No. 2016-207600

SUMMARY

Problems to be Solved

In the connector of Patent Reference 1, as discussed above, up-down movement within the above-mentioned holding portions is made possible with a certain degree of freedom in the above-mentioned range of play and the arm-portion blades permit variation in their inclined orientation relative to the forward-backward direction of the insulating plates. However, the presence of such play has led to problems including unstable blade orientation during connector assembly, laborious connector assembly operations, i.e., operations involving blade insertion into the holding portions of the housing, and the like.

In view of such circumstances, it is an object of the present invention to provide a right-angle electrical connector that facilitates connector assembly operations by stabilizing the orientation of the blades held in the housing.

Technical Solution

The inventive right-angle electrical connector has a guiding portion used for inserting and extracting a counterpart connector formed in a front portion of a housing holding blades that retain multiple electroconductive elongated members in place in array form with the help of insulating plates, and has a mounting surface for mounting to a circuit board on a bottom face of the housing forms an angle with a front face of said housing. The electroconductive elongated members retained in place by the above-mentioned insulating plates have arm portions extending in a rectilinear configuration in a forward-backward direction, i.e., the direction of connector insertion and extraction, and leg portions coupled to the rear ends of said arm portions via bend portions and extending downwardly toward the bottom portion. The above-mentioned arm portions have contact portions used for contacting corresponding terminals in a counterpart connector formed in the front end portions thereof, and the leg portions have connecting portions that are solder-connected to corresponding circuits on a circuit board formed at the lower ends thereof.

In the present invention, in such a right-angle electrical connector, the above-mentioned blades are formed such that the above-mentioned arm portions of the above-mentioned electroconductive elongated members are retained in place with the help of the above-mentioned insulating plates, the above-mentioned housing has formed therein holding portions allowing for the above-mentioned blades to be inserted from the rear, said holding portions have formed therein guiding portions guiding the insertion of the above-mentioned blades from the rear with the help of guiding grooves extending in the forward-backward direction, and movement of the above-mentioned blades in the up-down direction within the above-mentioned guiding grooves is restricted.

In the present invention, movement of the blades in the up-down direction is restricted by the guiding grooves formed in the holding portions of the housing. Therefore, the inclined orientation of the above-mentioned blades about an axial line (imaginary line) extending in the above-mentioned array direction on the major faces of said blades when viewed in the array direction of the electroconductive elongated members is minimized, as a result of which the major faces of said blades can be readily stabilized in an orientation parallel to the mounting face.

In the present invention, the above-mentioned guiding portions may be formed at both ends of the above-mentioned holding portions in the array direction of the above-mentioned electroconductive elongated members, and movement of the above-mentioned blades in the above-mentioned array direction within the guiding grooves of said guiding portions may be restricted. Thus, the inclined orientation of said blades about an axial line (imaginary line) extending in the up-down direction when viewed in the up-down direction is minimized by restricting the movement of the blades in the above-mentioned array direction within the guiding grooves, allowing for ready stabilization in an orientation extending in the forward-backward direction.

In the present invention, the above-mentioned blades may be adapted to have formed therein protrusions projecting from the major faces of the insulating plates, and the amount of insertion of the above-mentioned blades from the rear into the above-mentioned holding portions may be adapted to be restricted by said protrusions. Restricting the amount of insertion of the blades with the help of said protrusions in this manner prevents excessive insertion of said blades into the holding portions, as a result of which it becomes possible to easily place the blades at the normal location in the forward-backward direction.

In the present invention, the above-mentioned holding portions may have formed therein stopper portions used to restrict the amount of insertion of the blades from the rear at locations different from the above-mentioned guiding portions in the above-mentioned array direction, and the above-mentioned protrusions may be abuttable against the rear faces of said stopper portions at locations corresponding to the above-mentioned stopper portions in the above-mentioned array direction. In addition, the above-mentioned stopper portions may protrude from the interior wall surface of the above-mentioned holding portions.

In the present invention, the protrusions of the above-mentioned blades may be abuttable against the rear faces of said guiding portions at locations corresponding to the above-mentioned guiding portions in the above-mentioned array direction. Adopting such a configuration enables the above-mentioned guiding portions to also function as stopper portions.

In the present invention, there may be provided multiple types of the above-mentioned blades. In said multiple types of blades, the arm portions and the leg portions of the electroconductive elongated members of the various types of blades may be set to different lengths such that the arm portions of the electroconductive elongated members are positioned successively so as to be spaced apart from one another in the up-down direction and the leg portions of the electroconductive elongated members are positioned similarly in the forward-backward direction. A plurality of the above-mentioned holding portions may be formed in alignment with the various types of blades.

Technical Effect

In the present invention, as described above, movement of the blades in the up-down direction is restricted by the guiding grooves formed in the holding portions of the housing. For this reason, inclined orientation of the blades about an axial line extending in said array direction is minimized, as a result of which the major faces of said blades can be readily stabilized in an orientation parallel to the mounting face. Therefore, this facilitates connector assembly operations, that is, the operations of blade insertion into the holding portions of the housing.

DETAILED DESCRIPTION

Embodiments of the present invention will be described below with reference to the accompanying drawings.

Figure 1:
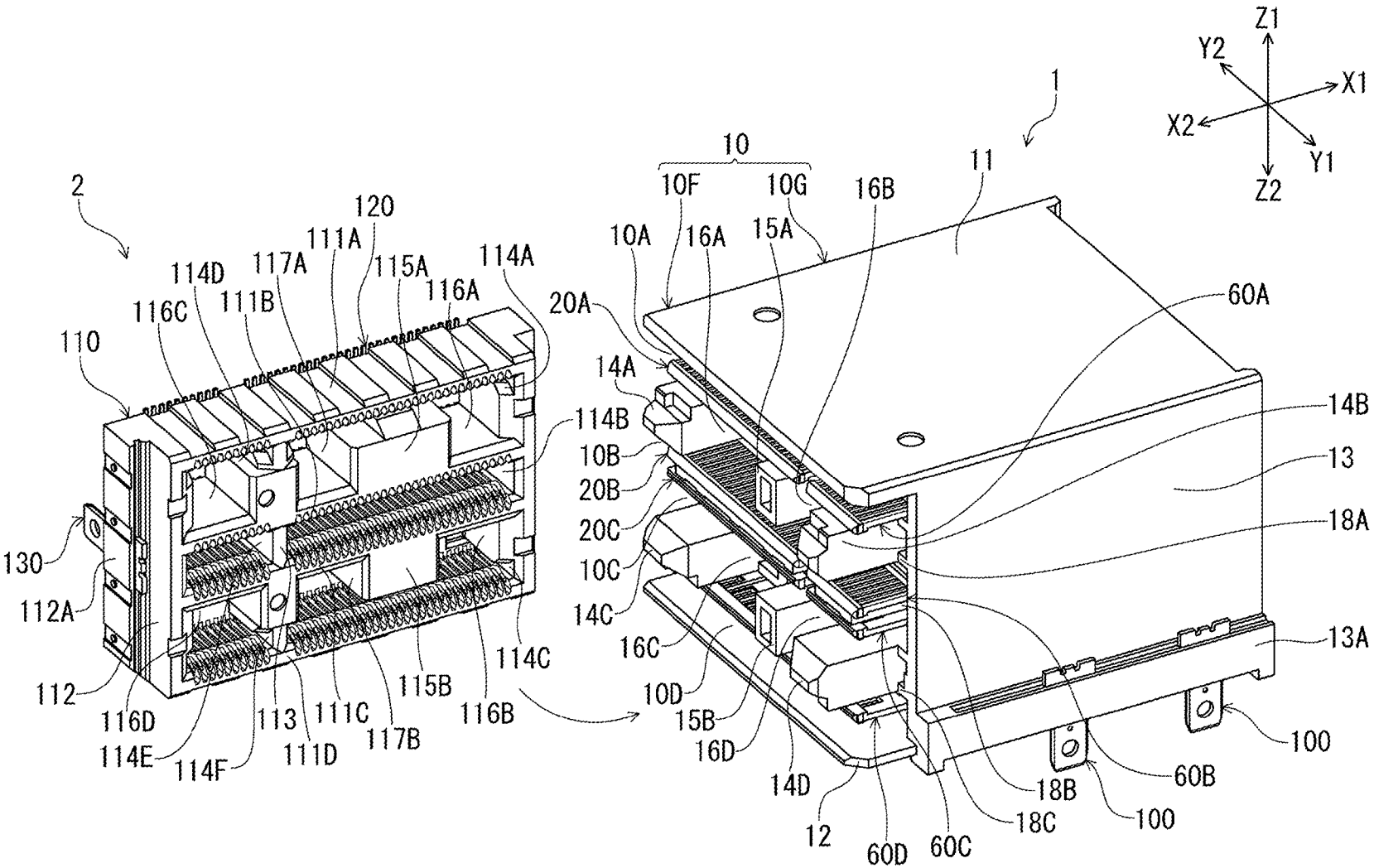
FIG. 1 illustrates a perspective view from above of a male connector and a female connector according to an embodiment of the present invention that shows their external appearance prior to connector mating.

FIG. 1, which is a perspective view from above of a male-type electrical connector 1 (hereinafter referred to simply as the "male connector 1") and a female-type electrical connector 2 serving as a counterpart connector for said connector 1 (hereinafter referred to as the "female connector 2") according to an embodiment of the present invention, shows their appearance in a state prior to connector mating.

Although immediately prior to connector mating the respective guiding portions of the male connector 1 and the female connector 2 according to the present embodiment are opposed to each other in the forward-backward direction (X-axis direction) (see FIG. 2 and FIG. 3), in FIG. 1, in order to illustrate the guiding portions of both connectors 1 and 2, the female connector 2 illustrated in an orientation obtained by rotating its orientation immediately prior to connector mating through a 90° angle about an axial line extending in the up-down direction (Z-axis direction). Accordingly, in FIG. 1, the forward-backward direction of the male connector 1 is the X-axis direction, and the forward-backward direction of the female connector 2 is the Y-axis direction.

The male connector 1 and the female connector 2 of the present embodiment, which are electrical connectors for circuit boards mounted to respective corresponding circuit boards (not shown) by solder connection, form an electrical connector assembly via mating connection to each other. In addition, the male connector 1 is a so-called right-angle electrical connector, in which the forward-backward direction (X-axis direction), i.e., the direction of insertion and extraction into and from the female connector 2, and the up-down direction perpendicular to the mounting face of the circuit board (Z-axis direction) are at right angles to each other. Furthermore, in the present embodiment, in the male connector 1 and the female connector 2, the direction perpendicular to both the forward-backward direction and the up-down direction is referred to as the "connector-width direction". Therefore, in FIG. 1, the connector-width direction of the male connector 1 is the Y-axis direction, and the connector-width direction of the female connector 2 is the X-axis direction.

Figure 2:
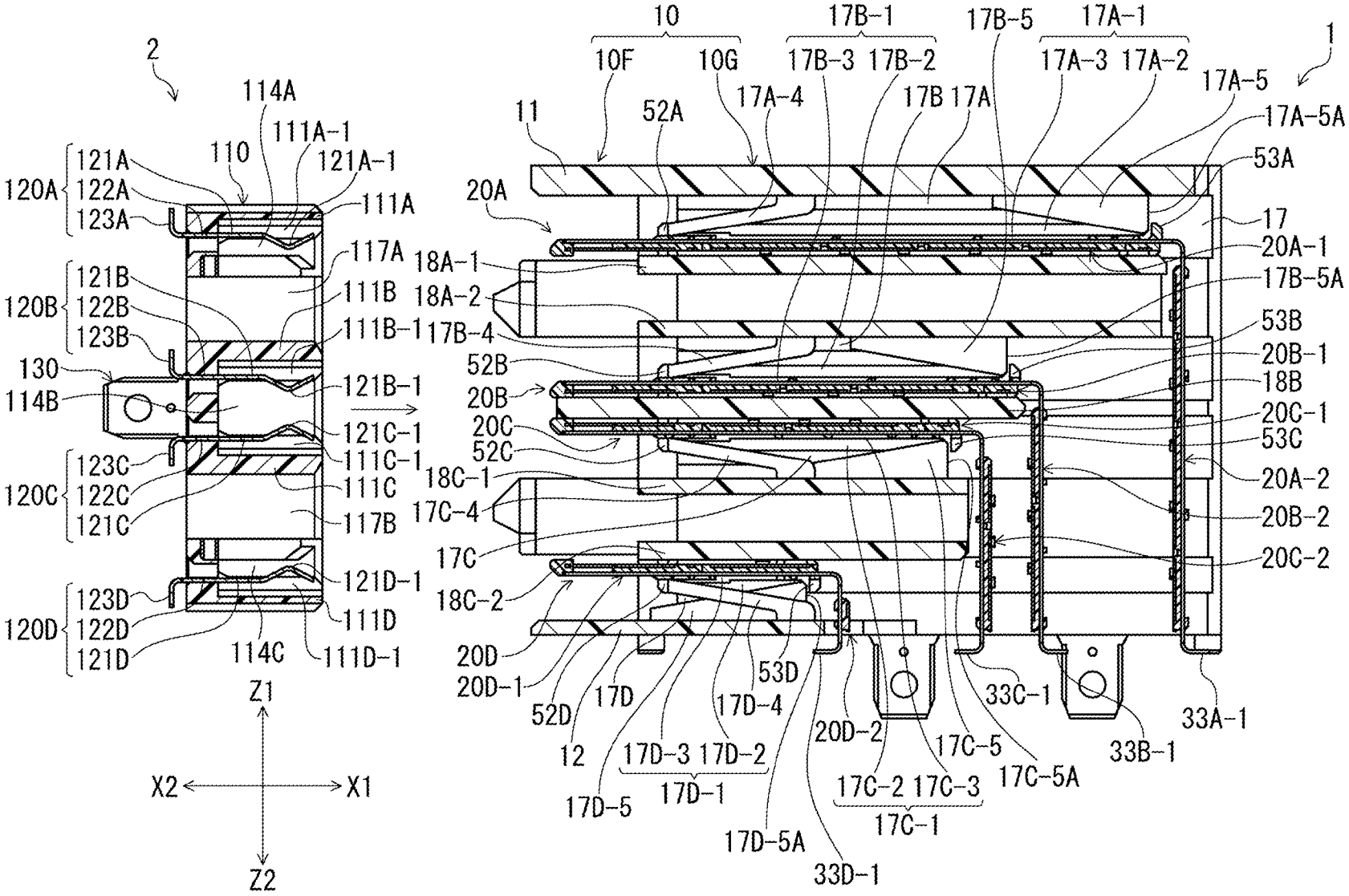
FIG. 2 illustrates a cross-sectional view taken in a cross section perpendicular to the connector-width direction of the male connector and the female connector prior to connector mating that shows a cross section through the wide mating area in the connector-width direction.
Figure 3:
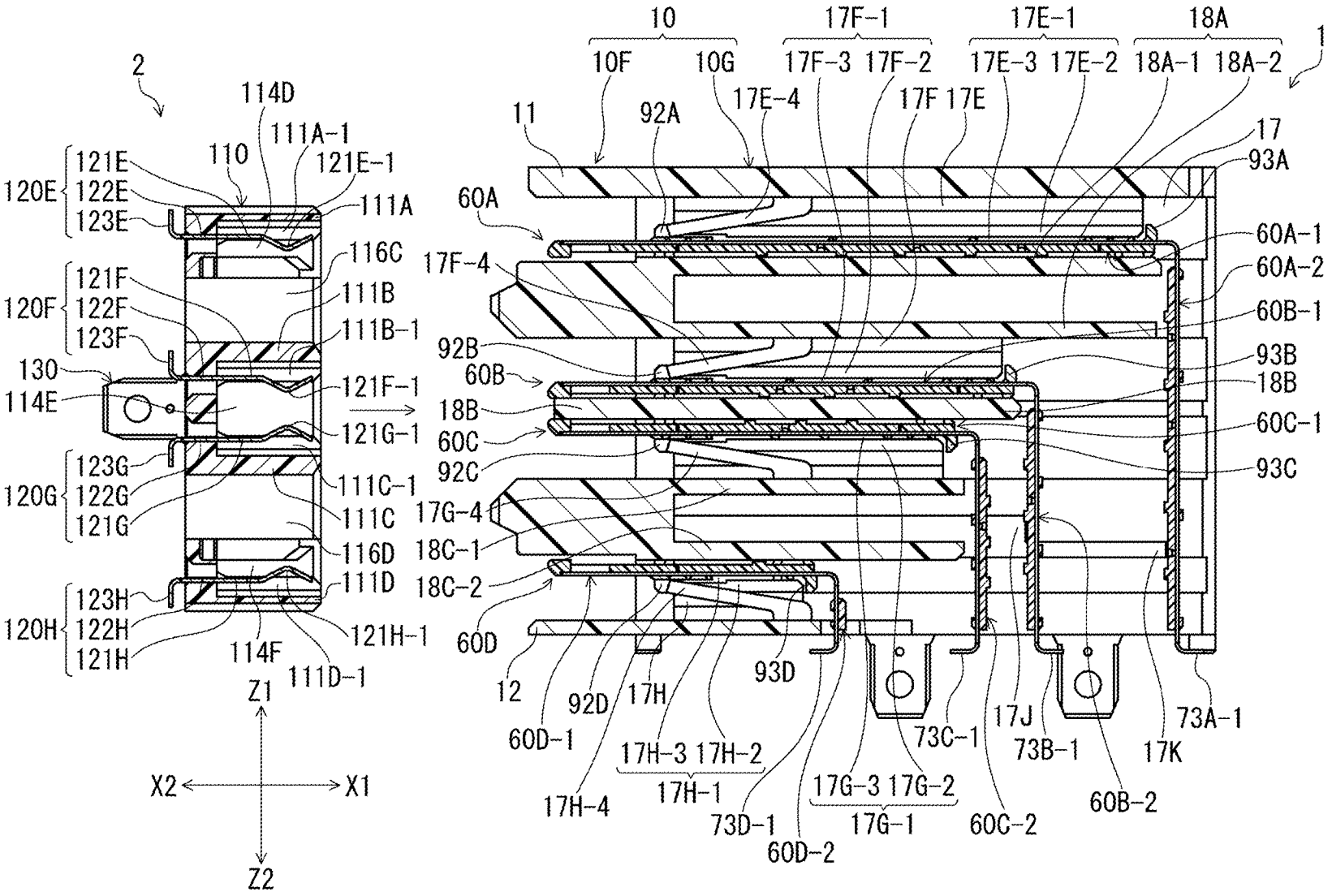
FIG. 3 illustrates a cross-sectional view taken in a cross section perpendicular to the connector-width direction of the connector prior to connector mating that shows a cross section through the narrow mating area in the connector-width direction.

FIG. 2 is a cross-sectional view taken in a cross section perpendicular to the connector-width direction (Y-axis direction) of the male connector 1 and the female connector 2 prior to connector mating that shows a cross section taken through a location in the hereinafter-described wide mating area in the connector-width direction. FIG. 3 is a cross-sectional view taken in a cross section perpendicular to the connector-width direction (Y-axis direction) of the connector prior to connector mating that shows a cross section taken through a location in the hereinafter-described narrow mating area in the connector-width direction. In FIG. 2 and FIG. 3, hatching is omitted in the cross-sections of the shielding plates and in the cross-sections of the terminals, which are explained hereinbelow.

The male connector 1, which is adapted for mating connection to the female connector 2 from the front (on side X2), has a housing 10, which is formed in a substantially rectangular parallelepiped-like external configuration from an electrically insulating material, four types of wide blades 20A, 20B, 20C, 20D and four types of narrow blades 60A, 60B, 60C, 60D, which are held within said housing 10, and mounting members 100, which are used to fixedly mount the housing 10 to a circuit board.

In the present embodiment, as shown in FIG. 2, the four types of wide blades of different shapes 20A, 20B, 20C, and 20D (hereinafter-described first wide blade 20A, second wide blade 20B, third wide blade 20C, and fourth wide blade 20D) have substantially horizontal L-shaped cross-sections and increase in size in the up-down and forward-backward directions in the order of the wide blades 20A, 20B, 20C, and 20D. One group of wide blades 20A, 20B, 20C, and 20D are retained in place in said housing 10 in array form so as to be positioned upwardly (on side Z1) and rearwardly (on side X1) in the order of said wide blades 20A, 20B, 20C, and 20D in the Y2 side region of the housing 10 in the connector-width direction (Y-axis direction). As described below, the respective wide blades 20A, 20B, 20C, and 20D have male terminals 30A, 30B, 30C, and 30D arranged such that the terminal array direction is the connector-width direction (blade-width direction).

In addition, in the present embodiment, as shown in FIG. 3, the four types of narrow blades of different shapes 60A, 60B, 60C, and 60D (hereinafter-described first narrow blade 60A, second narrow blade 60B, third narrow blade 60C, and fourth narrow blade 60D) have substantially horizontal L-shaped cross-sections and increase in size in the up-down and forward-backward directions in the order of the narrow blades 60A, 60B, 60C, and 60D. In addition, while the dimensions of the narrow blades 60A, 60B, 60C, and 60D in the forward-backward and up-down directions are identical to those of the above-described wide blades 20A, 20B, 20C, and 20D, their dimensions in the connector-width direction are smaller, in other words, narrower (see FIG. 5 and FIG. 6).

One group of narrow blades 60A, 60B, 60C, and 60D are retained in place in said housing 10 in array form so as to be positioned upwardly (on side Z1) and rearwardly (on side X1) in the order of said narrow blades 60A, 60B, 60C, and 60D in the Y1 side region of the housing 10 in the connector-width direction. As described below, the respective narrow blades 60A, 60B, 60C, and 60D have male terminals 70A, 70B, 70C, and 70D arranged such that the terminal array direction is the connector-width direction (blade-width direction).

[Housing Configuration]

As can be seen in FIG. 1, the housing 10 has a top wall 11 and a bottom wall 12, as well as lateral walls 13, which couple the lateral edges of the two, with a mounting surface used for mounting to a circuit board provided on the bottom face of the bottom wall 12, in other words, the bottom face of the housing 10. The top wall 11 and the bottom wall 12 protrude forwardly of the lateral walls 13 (on side X1 in FIG. 1). Furthermore, in a space enclosed by the top wall 11, the bottom wall 12, and lateral walls 13, there are formed, in order from the top, a hereinafter-described upper partition 18A, middle partition 18B, and lower partition 18C (which are collectively referred to as "partitions 18A, 18B, 18C" whenever necessary). The front ends of the upper partition 18A and lower partition 18C are located at the same position in the forward-backward direction as the front ends of the lateral walls 13, and the front end of the middle partition 18B is located forwardly of the front ends of the lateral walls 13 (also see FIG. 4 (A)). In the housing 10, the section located forwardly of the lateral walls 13 and partitions 18A, 18C serves as a guiding portion 10F used for mating with the female connector 2. Said guiding portion 10F is divided into two portions, i.e., a region corresponding to the wide blades 20A to 20D (male-side wide mating area) located proximate the Y2 side relative to the hereinafter-described intermediate wall 10E in the connector-width direction (Y-axis direction) and a region corresponding to the narrow blades 60A to 60D (male-side narrow mating area) located proximate the Y1 side relative to the intermediate wall 10E in the connector-width direction.

In the above-mentioned male-side wide mating area, the front end section of the first wide blade 20A is located at the top in the space between the top wall 11 and the middle partition 18B, and the front end section of the second wide blade 20B is located at the bottom. In addition, in the above-mentioned male-side narrow mating area, the front end section of the first narrow blade 60A is located at the top in the space between the top wall 11 and the middle partition 18B, and the front end section of the second narrow blade 60B is located at the bottom. The male contact portions 31A-1 of the male terminals 30A are exposed on the top face of the front end section of the first wide blade 20A, and the male contact portions 31B-1 of the male terminals 30B are exposed on the top face of the front end section of the second wide blade 20B (see FIG. 2). The male contact portions 71A-1 of the male terminals 70A are exposed on the top face of the front end section of the first narrow blade 60A, and the male contact portions 71B-1 of the male terminals 70B are exposed on the top face of the front end section of the second narrow blade 20B (see FIG. 3).

A first connecting space 10A used to receive the hereinafter-described first terminal retaining wall 111A of the female connector 2 is formed along the above-mentioned first blades 20A, 60A between the top wall 11 and the front end sections of the first blades 20A, 60A. A second connecting space 10B used to receive the hereinafter-described second terminal retaining wall 111B of the female connector 2 is formed along the above-mentioned second blades 20B, 60B directly above the front end sections of the second blades 20B, 60B.

In addition, a male-side upper mating area corresponding to the hereinafter-described female-side upper mating area of the female connector 2 is formed between the first blades 20A, 60A and the second connecting space 10B. Said male-side upper mating area is divided into two portions, i.e., a male-side upper wide mating area formed in a range corresponding to the male-side wide mating area and a male-side upper narrow mating area formed in a range corresponding to the male-side narrow mating area. An upper wide guiding portion 14A and an upper narrow guiding portion 14B, which extend forwardly of the upper partition 18A at locations proximate to both ends in the connector-width direction, and an upper restricting portion 15A, which extends forwardly from the upper partition 18A at an intermediate location in the connector-width direction, are formed in said male-side upper mating area.

The upper wide guiding portion 14A is located at the end of side Y2 in the male-side upper mating area in the connector-width direction. On the other hand, the upper narrow guiding portion 14B, whose dimensions in the connector-width direction are smaller than those of said upper wide guiding portion 14A, is located at the end of side Y1 in the male-side upper mating area in the connector-width direction. The upper restricting portion 15A is formed at the end of side Y1 in the male-side upper wide mating area, in other words, at the end on the side proximate to the male-side upper narrow mating area.

An upper block portion-receiving space 16A used to receive the hereinafter-described upper block portion 115A of the female connector 2 is formed between the upper wide guiding portion 14A and the upper restricting portion 15A in the male-side upper wide mating area. In addition, an upper intermediate wall-receiving space 16B used to receive the hereinafter-described intermediate wall 113 of the female connector 2 is formed between the upper narrow guiding portion 14B and the upper restricting portion 15A in the male-side upper narrow mating area.

In the above-mentioned male-side wide mating area, the front end section of the third wide blade 20C is located at the top in the space between the middle partition 18B and the bottom wall 12, and the front end section of the fourth wide blade 20D is located at the bottom. In addition, in the above-mentioned male-side narrow mating area, the front end section of the third narrow blade 60C is located at the top in the space between the middle partition 18B and the bottom wall 12, and the front end section of the fourth narrow blade 60D is located at the bottom. The male contact portions 31C-1 of the male terminals 30C are exposed on the bottom face of the front end section of the third wide blade 20C, and the male contact portions 31D-1 of the male terminals 30D are exposed on the bottom face of the front end section of the fourth wide blade 20D (see FIG. 2). The male contact portions 71C-1 of the male terminals 70C are exposed on the bottom face of the front end section of the third narrow blade 60C, and the male contact portions 71D-1 of the male terminals 70D are exposed on the bottom face of the front end section of the fourth narrow blade 60D (see FIG. 3).

A third connecting space 10C used to receive the hereinafter-described third terminal retaining wall 111C of the female connector 2 is formed along the above-mentioned third blades 20C, 60C directly below the front end sections of the above-mentioned third blades 20C, 60C. A fourth connecting space 10D used to receive the hereinafter-described fourth terminal retaining wall 111D of the female connector 2 is formed along the above-mentioned fourth blades 20D, 60D between the bottom wall 12 and the front end sections of the fourth blades 20D, 60D.

In addition, a male-side lower mating area, which corresponds to the hereinafter-described female-side lower mating area of the female connector 2, is formed between the third connecting space 10C and the fourth blades 20D, 60D. Said male-side lower mating area is divided into two portions, i.e., a male-side lower wide mating area formed in a range corresponding to the male-side wide mating area and a male-side lower narrow mating area formed in a range corresponding to the male-side narrow mating area. A lower wide guiding portion 14C and a lower narrow guiding portion 14D, which extend forwardly from the lower partition 18C at locations proximate to both ends in the connector-width direction, and a lower restricting portion 15B, which extends forwardly from the lower partition 18C at an intermediate location in the connector-width direction, are formed in said male-side lower mating area.

The lower wide guiding portion 14C is located at the end of side Y2 in the male-side lower mating area in the connector-width direction. On the other hand, the lower narrow guiding portion 14D, whose dimensions in the connector-width direction are smaller than those of said lower wide guiding portion 14C, is located at the end of side Y1 in the male-side lower mating area in the connector-width direction. The lower restricting portion 15B is formed at the end of side Y1 in the male-side lower wide mating area, in other words, at the end on the side proximate to the male-side lower narrow mating area. As can be seen in FIG. 1, the lower wide guiding portion 14C, lower narrow guiding portion 14D, and lower restricting portion 15B are formed respectively at the same locations in the connector-width direction (Y-axis direction) as the upper wide guiding portion 14A, upper narrow guiding portion 14B, and upper restricting portion 15A of the male-side upper mating area.

A lower block portion-receiving space 16C used to receive the hereinafter-described lower block portion 115B of the female connector 2 is formed between the lower wide guiding portion 14C and the lower restricting portion 15B in the male-side lower wide mating area. In addition, a lower intermediate wall-receiving space 16D used to receive the hereinafter-described intermediate wall 113 of the female connector 2 is formed between the lower narrow guiding portion 14D and the lower restricting portion 15B in the male-side lower narrow mating area.

The distal end portions of the respective guiding portions 14A, 14B, 14C, and 14D, which have a tapered configuration, are adapted to guide the hereinafter-described block portions 115A, 115B and the intermediate wall 113 of the female connector 2 into the block portion-receiving spaces 16A, 16C and the intermediate wall-receiving spaces 16B, 16D. In addition, the inner lateral faces of said guiding portions 14A, 14B, 14C, and 14D (faces opposed to the restricting portions 15A, 15B in the connector-width direction) serve as restricting faces that restrict the movement of the above-mentioned block portions 115A, 115B and the above-mentioned intermediate wall 113 in the connector-width direction when the connectors are mated.

As can be seen in FIG. 1, the respective restricting portions 15A, 15B extend in the forward-backward direction in a hollow prism-like configuration and both lateral faces in the connector-width direction (faces on two sides perpendicular to the connector-width direction) serve as restricting faces that restrict the movement of the above-mentioned block portions 115A, 115B and the above-mentioned intermediate wall 113 of the female connector 2 in the connector-width direction when the connectors are mated.

As can be seen in FIG. 1, mounting portions 13A, which protrude outwardly in the connector-width direction, are provided extending in the forward-backward direction (X-axis direction) at the bottom of the lateral walls 13 of the housing 10, and mounting members 100 made of sheet metal material are provided protruding downwardly (on side Z2) of the bottom wall 12 on said mounting portions 13A.

As can be seen in FIG. 2 and FIG. 3, behind the previously described guiding portion 10F, the housing 10 has formed therein a blade holding portion 10G used to hold and retain in place the wide blades 20A to 20D and the narrow blades 60A to 60D. Said blade holding portion 10G has a holding space 17 holding the wide blades 20A to 20D and the narrow blades 60A to 60D that is formed passing therethrough in the forward-backward direction. In addition, as can be seen in FIG. 2 and FIG. 3, the holding space 17 is open downwardly in the rear half (section on side X1).

The upper partition 18A, middle partition 18B, and lower partition 18C, which have major faces that are parallel to the top wall 11 and the bottom wall 12 and which couple the two lateral walls 13, are provided in order from the top in the holding space 17. In addition, an intermediate wall 10E, which has major faces that are parallel to the lateral walls 13 and couples the top wall 11, upper partition 18A, middle partition 18B, lower partition 18C, and bottom wall 12 at an intermediate location proximate to the side Y1 in the connector-width direction, is provided in the holding space 17.

As a result, a first wide holding groove 17A is formed between the top wall 11 and the upper partition 18A, a second wide holding groove 17B is formed between the upper partition 18A and the middle partition 18B, a third wide holding groove 17C is formed between the middle partition 18B and the lower partition 18C, and a fourth wide holding groove 17D is formed between the lower partition 18C and the bottom wall 12 in the holding space 17 in a region more proximate to the Y2 side in the connector-width direction than the intermediate wall 10E, in other words, in a region corresponding to the male-side wide mating area. In addition, a first narrow holding groove 17E is formed between the top wall 11 and the upper partition 18A, a second narrow holding groove 17F is formed between the upper partition 18A and the middle partition 18B, a third narrow holding groove 17G is formed between the middle partition 18B and the lower partition 18C, and a fourth narrow holding groove 17H is formed between the lower partition 18C and the bottom wall 12 in the holding space 17 in a region more proximate to the Y1 side in the connector-width direction than the intermediate wall 10E, in other words, in a region corresponding to the male-side narrow mating area.

As can be seen in FIG. 2, the hereinafter-described arm-portion blades 20A-1 to 20D-1 of the wide blades 20A to 20D are inserted from the rear and held in the respective wide holding grooves 17A to 17D. In addition, as can be seen in FIG. 3, the hereinafter-described arm-portion blades 60A-1 to 60D-1 of the blades 60A to 60D are inserted from the rear and held in the respective narrow holding grooves 17E to 17H.

Figure 4:
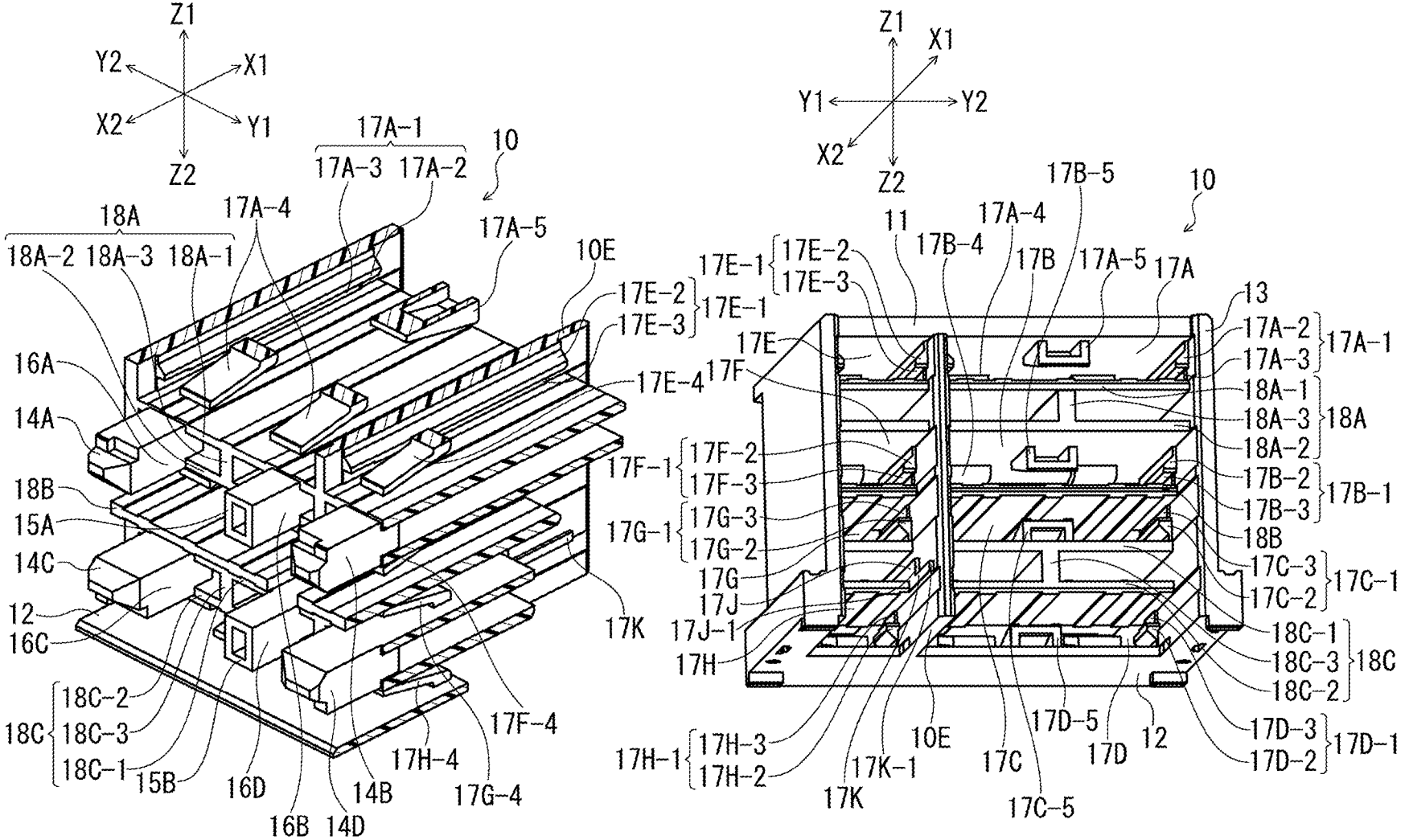
FIG. 4 (A) is a perspective view from the front and above of a portion of the housing of the male connector, and FIG. 4 (B) is a perspective view from behind and below of the entire housing of the male connector.

The upper partition 18A is formed by coupling an upper top partition 18A-1 and an upper bottom partition 18A-2, whose major surfaces are in a face-to-face relationship in the up-down direction, with the help of multiple upper coupling wall portions 18A-3 having major surfaces perpendicular to the connector-width direction and extending in the forward-backward direction (see FIGS. 4 (A) and 4(B)). As can be seen in FIG. 4 (A), said upper coupling wall portions 18A-3 are formed between the upper restricting portion 15A and the upper wide guiding portion 14A in the connector-width direction. The upper top partition 18A-1 extends in the forward-backward direction level with the top of the upper guiding portions 14A, 14B, and the upper bottom partition 18A-2 extends in the forward-backward direction level with the bottom of the upper guiding portions 14A, 14B. The upper top partition 18A-1, upper bottom partition 18A-2, and upper coupling wall portions 18A-3 extend to the vicinity of the rear end of the housing 10.

The middle partition 18B extends as a single wall portion in said forward-backward direction at a central location of the holding space 17 in the up-down direction. As discussed before, the front end of the middle partition 18B is located forwardly (on side X2) of the lateral walls 13, in other words, forwardly of the holding space 17, and, at the same time, its rear end is located forwardly of the rear end of the upper partition 18A.

The lower partition 18C is formed by coupling a lower top partition 18C-1 and a lower bottom partition 18C-2, whose major surfaces are in a face-to-face relationship in the up-down direction, with the help of multiple lower coupling wall portions 18C-3 having major surfaces perpendicular to the connector-width direction and extending in the forward-backward direction (see FIGS. 4 (A) and 4 (B)). As can be seen in FIG. 4 (A), said lower coupling wall portions 18C-3 are formed between the lower restricting portion 15B and the lower wide guiding portion 14C in the connector-width direction. The lower top partition 18C-1 extends in the forward-backward direction level with the top of the lower guiding portions 14C, 14D, and the lower bottom partition 18C-2 extends in the forward-backward direction level with the bottom of the lower guiding portions 14C, 14D. The rear end of the lower partition 18C is located forwardly of the rear end of the upper partition 18A.

As can be seen in FIG. 2 and FIG. 4 (B), guiding portions 17A-1 to 17D-1 extending in the forward-backward direction, which guide the insertion of the arm-portion blades 20A-1 to 20D-1 of the wide blades 20A to 20D from the rear, are formed on the two sides of the interior wall surfaces located in the connector-width direction of the interior wall surfaces that form the respective wide holding grooves 17A to 17D, in other words, the respective major faces of the intermediate wall 10E and the lateral walls 13 opposed to each other in the connector-width direction. Said guiding portions 17A-1 to 17D-1 have guiding projections 17A-2 to 17D-2, which protrude from the interior wall surfaces on said two sides of the wide holding grooves 17A to 17D at intermediate locations of the wide holding grooves 17A to 17D in the up-down direction and extend in the forward-backward direction, and guiding grooves 17A-3 to 17D-3, which extend in the forward-backward direction along said guiding projections 17A-2 to 17D-2. The guiding projections 17A-2 to 17D-2 and guiding grooves 17A-3 to 17D-3 extend in the forward-backward direction from locations at the rear ends of the wide holding grooves 17A to 17D to locations in the vicinity of the front ends, in other words, over substantially the entire extent of the wide holding grooves 17A to 17D in the forward-backward direction.

In the present embodiment, the rear end face of the guiding projection 17A-2 abuts, from the front, the hereinafter-described rear protrusion 53A of the arm-portion blade 20A-1 inserted into the wide holding grooves 17A to 17D from the rear, thereby making it possible to restrict the amount of insertion of said arm-portion blades 20A-1 to 20D-1. In other words, the guiding projection 17A-2 also serves as a stopper portion abuttable against the rear protrusion 53A of the arm-portion blade 20A-1.

As can be seen in FIG. 2 and FIGS. 4 (A) and 4 (B), the guiding grooves 17A-3 and 17B-3 are formed respectively under the guiding projections 17A-2 and 17B-2. In other words, the guiding groove 17A-3 is formed between the guiding projection 17A-2 and the upper partition 18A, and the guiding groove 17B-3 is formed between the guiding projection 17B-2 and the middle partition 18B. In addition, the guiding grooves 17C-3, 17D-3 are formed respectively above the guiding projections 17C-2, 17D-2. In other words, the guiding groove 17C-3 is formed between the guiding projection 17C-2 and the middle partition 18B, and the guiding groove 17D-3 is formed between the guiding projection 17D-2 and the lower partition 18C.

In the present embodiment, when the arm-portion blades 20A-1 to 20D-1 of the wide blades 20A to 20D are inserted into the respective wide holding grooves 17A to 17D from the rear during the assembly of the connector 1, both ends of said arm-portion blades 20A-1 to 20D-1 in the connector-width direction are adapted to travel forward within the guiding grooves 17A-3 to 17D-3 while having their upward or downward movement restricted by the guiding projections 17A-2 to 17D-2 and the partitions 18A to 18C opposed thereto.

As can be seen in FIG. 2, multiple resilient engagement pieces 17A-4 to 17D-4 used to restrict the rearward movement of the respective blades 20A to 20D are provided within the wide holding grooves 17A to 17D. Said resilient engagement pieces 17A-4 to 17D-4, which are provided in the respective holding grooves 17A to 17D in a cantilever configuration that is resiliently deformable in the up-down direction, are adapted to restrict the rearward movement of the arm-portion blades 20A-1 to 20D-1 held in the holding grooves 17A to 17D. Said resilient engagement pieces 17A-4 to 17D-4 comprise two first resilient engagement pieces 17A-4, which extend from the bottom face of the top wall 11 in the first wide holding groove 17A and restrict the movement of the first wide blade 20A, two second resilient engagement pieces 17B-4, which extend from the bottom face of the upper bottom partition 18A-2 in the second wide holding groove 17B and restrict the movement of the second wide blade 20B, two third resilient engagement pieces 17C-4, which extend from the top face of the lower top partition 18C-1 in the third wide holding groove 17C and restrict the movement of the third wide blade 20C, and two fourth resilient engagement pieces 17D-4, which extend from the top face of the bottom wall 12 in the fourth wide holding groove 17D and restrict the movement of the fourth wide blade 20D.

FIG. 4 (A) is a perspective view from the front and above of a portion of the housing 10 of the male connector 1, and FIG. 4 (B) is a perspective view from behind and below of the entire housing 10 of the male connector 1. The top wall 11 and the proximal lateral wall 13 (on the side Y1 in the Y-axis direction) of the housing 10 are omitted in FIG. 4 (A).

As can be seen in FIG. 2 and FIG. 4 (A), the two first resilient engagement pieces 17A-4 are positioned in a mutually spaced relationship in the connector-width direction and extend forwardly from locations proximate to the front end of the top wall 11 to locations in the vicinity of the front end of the upper top partition 18A-1. The two second resilient engagement pieces 17B-4 are positioned in a mutually spaced relationship in the connector-width direction and extend forwardly from intermediate locations in the forward-backward direction of the upper bottom partition 18A-2 to locations in the vicinity of the front end of the middle partition 18B. The two third resilient engagement pieces 17C-4 are positioned in a mutually spaced relationship in the connector-width direction and extend forwardly from intermediate locations in the forward-backward direction of the lower top partition 18C-1 to locations in the vicinity of the front end of said lower top partition 18C-1. The two fourth resilient engagement pieces 17D-4 are positioned in a mutually spaced relationship in the connector-width direction and extend forwardly from locations at the rear end of the bottom wall 12 to locations in the vicinity of the front end of the lower bottom partition 18C-2.

As can be seen in FIG. 2 and FIGS. 4 (A) and 4 (B), stopper portions 17A-5 to 17D-5 used to restrict the amount of insertion of the arm-portion blades 20A-1 to 20D-1 from the rear are provided in the wide holding grooves 17A to 17D. Said stopper portions 17A-5 to 17D-5 comprise a single first stopper portion 17A-5, which protrudes from the bottom face of the top wall 11 in the first wide holding groove 17A and restricts the amount of insertion of the arm-portion blade 20A-1 of the first wide blade 20A, a single second stopper portion 17B-5, which protrudes from the bottom face of the upper bottom partition 18A-2 in the second wide holding groove 17B and restricts the amount of insertion of the arm-portion blade 20B-1 of the second wide blade 20B, a single third stopper portion 17C-5, which protrudes from the top face of the lower top partition 18C-1 in the third wide holding groove 17C and restricts the amount of insertion of the arm-portion blade 20C-1 of the third wide blade 20C, and a single fourth stopper portion 17D-5, which protrudes from the top face of the bottom wall 12 in the fourth wide holding groove 17D and restricts the amount of insertion of the arm-portion blade 20D-1 of the fourth wide blade 20D.

As can be seen in FIG. 2, among the stopper portions 17A-5 to 17D-5, the bottom faces of the stopper portions 17A-5, 17B-5 are upwardly inclined in the forward direction while their rear end faces are flat faces perpendicular to the forward-backward direction. In addition, the stopper portions 17C-5, 17D-5 have a configuration that is obtained by vertically flipping the stopper portions 17A-5, 17B-5. The stopper portions 17A-5 to 17D-5 are located at central locations of the wide holding grooves 17A to 17D in the connector-width direction, in other words, between two resilient engagement pieces 17A-4 to 17D-4. In addition, in the forward-backward direction, said stopper portions 17A-5 to 17C-5 are provided at locations proximate to the rear ends of the wide retaining grooves 17A to 17C rearwardly of the resilient engagement pieces 17A-4 to 17C-4. As can be seen in FIG. 2, the fourth stopper portion 17D-5, which is provided over substantially the entire extent of the fourth wide holding groove 17D in the forward-backward direction, is positioned with some overlap with the fourth resilient engagement pieces 17D-4.

The rear end faces of said stopper portions 17A-5 to 17D-5 are located in front of the hereinafter-described rear protrusions 53A to 53D formed on the arm-portion blades 20A-1 to 20D-1 of the wide blades 20A to 20D in a manner permitting abutment against said rear protrusions 53A to 53D and are formed as stopper faces 17A-5A to 17D-5A used to restrict the amount of insertion of the arm-portion blades 20A-1 to 20D-1 from the rear.

The narrow holding grooves 17E to 17H are configured by reducing the dimensions of the previously described wide holding grooves 17A to 17D in the connector-width direction and omitting one resilient engagement piece 17A-4 to 17D-4 and the stopper portions 17A-5 to 17D-5. Accordingly, as can be seen in FIG. 3 and FIGS. 4 (A) and 4 (B), a pair of guiding portions 17E-1 to 17H-1 and a single resilient engagement piece 17E-4 to 17H-4 are provided in the narrow holding grooves 17E to 17H. Each of said resilient engagement piece 17E-4 to 17H-4 is provided in each narrow holding groove 17E to 17H at a central location in the connector-width direction. In the present embodiment, the guiding portions 17E-1 to 17H-1, in the same manner as the rear end faces of the previously described guiding projections 17A-2, serve as stopper portions restricting the amount of insertion of the arm-portion blades 60A-1 to 60D-1 of the narrow blades 60A and 60B from the rear.

In FIG. 3, in the narrow holding grooves 17E to 17H, reference numerals obtained by replacing "A" to "D" in the numerals of the parts of the wide holding grooves 17A to 17D with "E" to "H" are assigned to parts corresponding to the respective components of the wide holding grooves 17A to 17D.

Figure 8:
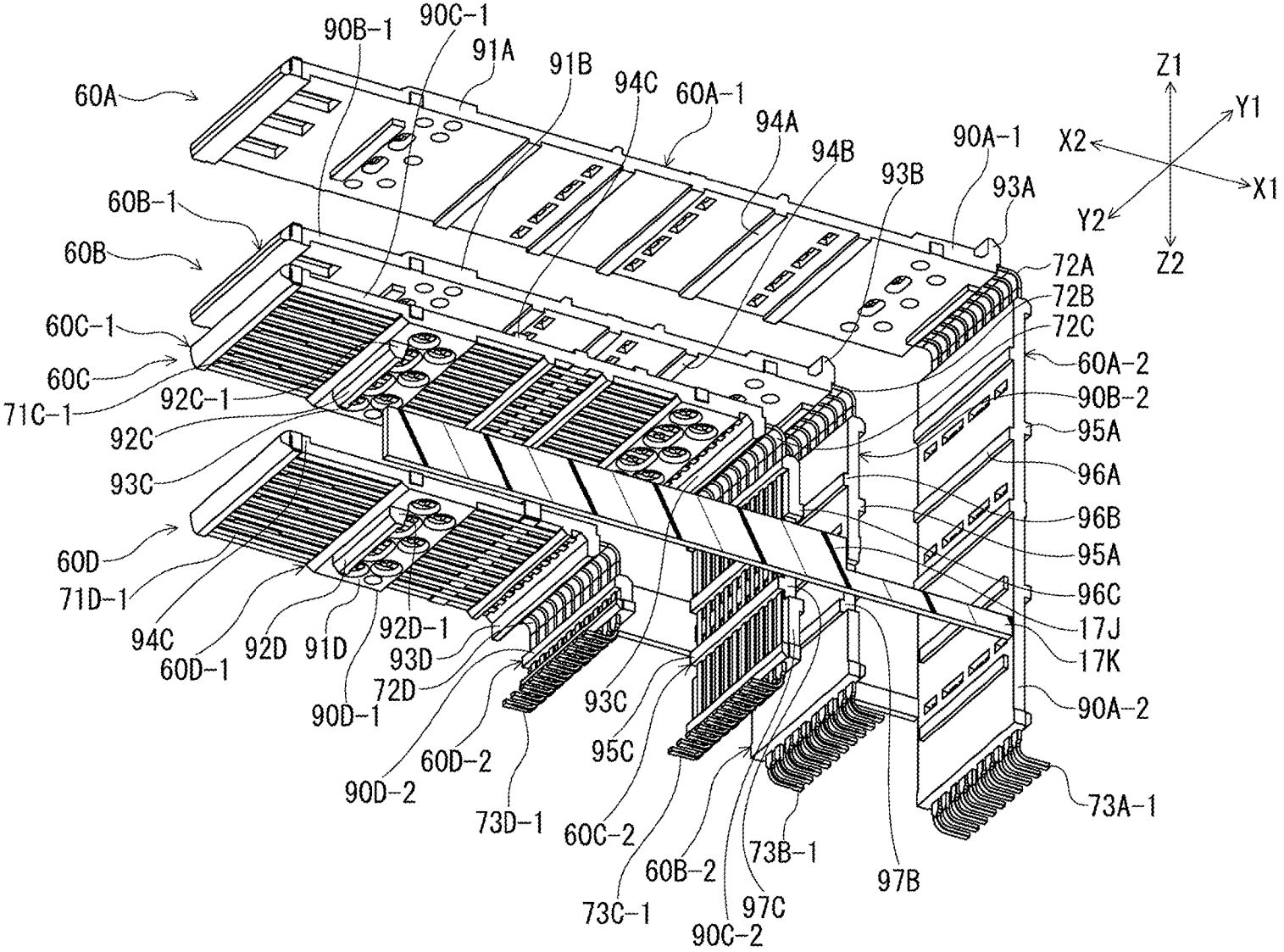
FIG. 8 illustrates a perspective view from below of the first through fourth narrow blades along with the blade-restricting portions of the male housing.

As can be seen in FIG. 3, the blade holding portion 10G has formed therein, in a region located more proximately to the Y1 side than the intermediate wall 10E, a front blade-restricting portion 17J and a rear blade-restricting portion 17K protruding from the wall surface of the intermediate wall 10E on side Y1 and the interior wall surface of the lateral wall 13 opposed thereto (not shown in FIG. 3) (see also FIG. 8).

As can be seen in FIG. 3, the front blade-restricting portion 17J is located slightly behind the rear end of the middle partition 18B in the forward-backward direction and, at the same time, between the lower top partition 18C-1 and the lower bottom partition 18C-2 in the up-down direction. A front blade-restricting face 17J-1, i.e., the rear end face of the front blade-restricting portion 17J, is located in front of the leg-portion blade 60C-2 of the third narrow blade 60C in the normal position, with a slight gap left between it and the front face of said leg-portion blade 60C-2.

As can be seen in FIG. 3, the rear blade-restricting portion 17K is located slightly behind the rear end of the upper partition 18A in the forward-backward direction and, at the same time, substantially level with the lower bottom partition 18C-2 in the up-down direction. Namely, said rear blade-restricting portion 17K is located behind and below the front blade-restricting face 17J-1. A rear blade-restricting face 17K-1, which constitutes the rear end face of said rear blade-restricting portion 17K, is located in front of the leg-portion blade 60D-2 of the fourth narrow blade 60D in the normal position, with a slight gap left between it and the front face of said leg-portion blade 60D-2. Hereinbelow, whenever necessary, the front blade-restricting portion 17J and the rear blade-restricting portion 17K are collectively referred to as "blade-restricting portions 17J, 17K".

Thus, the blade-restricting faces 17J-1, 17K-1 are positioned in a face-to-face relationship with the front faces of the leg-portion blades 60C-2, 60D-2 and, as described hereafter, are adapted to abut the front faces of said leg-portion blades 60C-2, 60D-2 and restrict their further displacement if the leg-portion blades 60C-2, 60D-2 are displaced forwardly when the male connector 1 is heated during mounting of the connector to the circuit board (see FIG. 8).

[Configuration of Wide Blades and Narrow Blades]

Figure 5:
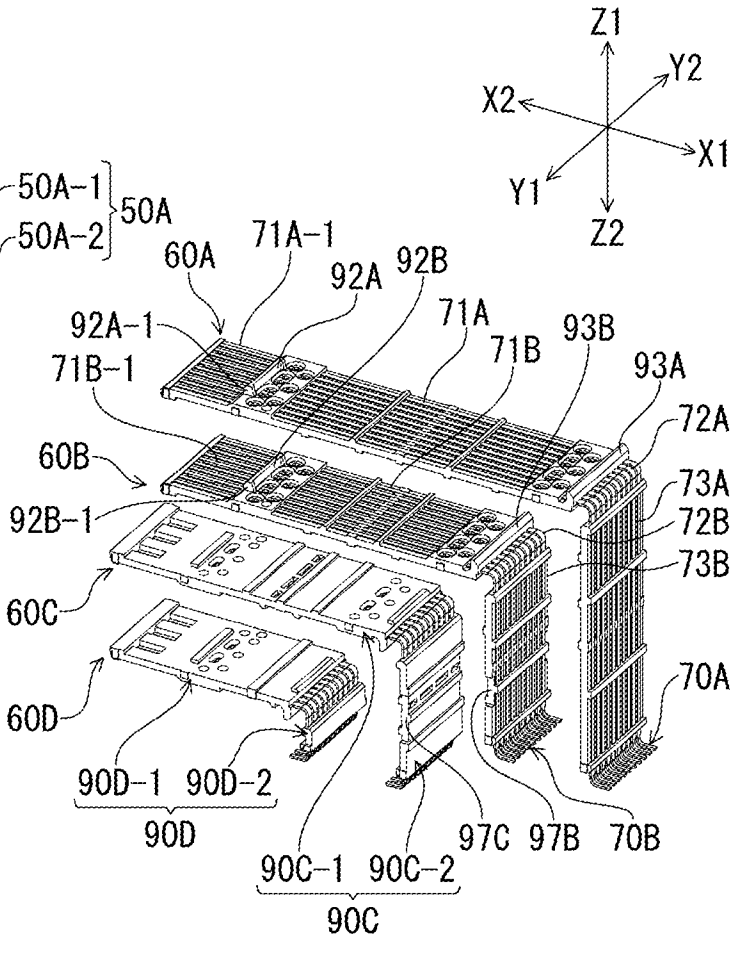
FIG. 5 (A) is a perspective view from above of the first through fourth wide blades, and FIG. 5 (B) is a perspective view from above of the first through fourth narrow blades.
Figure 6:
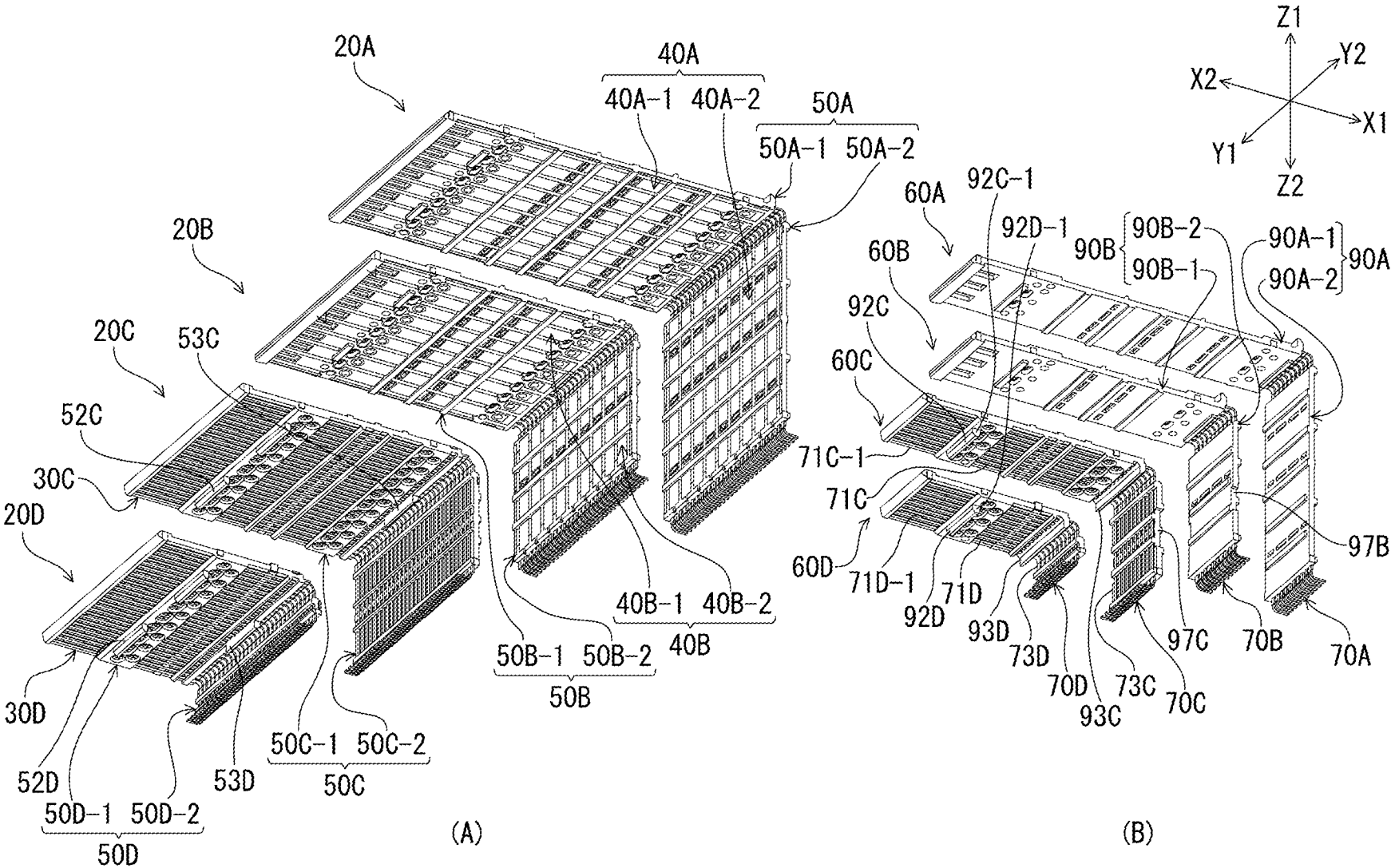
FIG. 6 (A) is a perspective view from below of the first through fourth wide blades, and FIG. 6 (B) is a perspective view from below of the first through fourth narrow blades.
Figure 7:
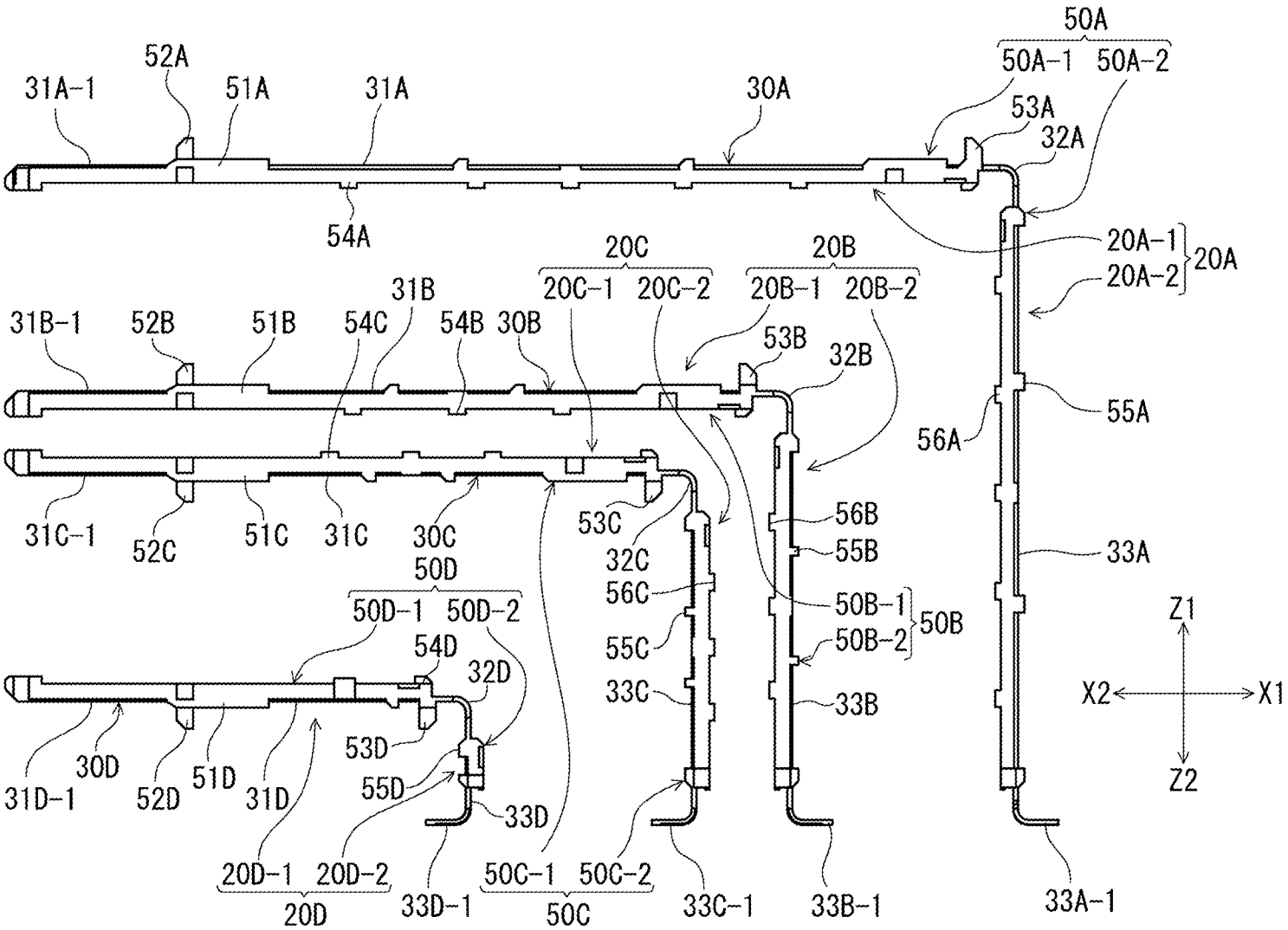
FIG. 7 illustrates a side view of the first through fourth wide blades.

The configuration of the wide blades 20A to 20D and the narrow blades 60A to 60D will be described below. FIG. 5 (A) is a perspective view of the wide blades 20A to 20D from above, and FIG. 5 (B) is a perspective view of the narrow blades 60A to 60D from above. FIG. 6 (A) is a perspective view of the wide blades 20A to 20D from below, and FIG. 6 (B) is a perspective view of the narrow blades 60A to 60D from below. FIG. 7 is a side view of the wide blades 20A to 20D.

The four types of wide blades 20A to 20D and the four types of narrow blades 60A to 60D are fabricated by retaining in place, with the help of insulating plates, multiple terminals disposed in an array in the connector-width direction and shielding plates disposed so as to cover the array range of said multiple terminals. The four types of narrow blades 60A to 60D differ from the wide blades 20A to 20D in that their width dimensions (dimensions in the connector-width direction) are narrower than those of said wide blades 20A to 20D and, in addition, in that they are not provided with shielding plates. In the present embodiment, the configuration of the wide blades 20A to 20D will be described first, and the configuration of the narrow blades 60A to 60D will then be described with emphasis on the differences from the configuration of the wide blades 20A to 20D. Although the respective lengths of the insulating plates and terminals of the four types of wide blades 20A to 20D are different, they share a common basic configuration. Therefore, the configuration of the first wide blade 20A will be described first, and the configurations of the second wide blade 20B, third wide blade 20C, and fourth wide blade 20D will be described with emphasis on their differences from the other blades.

As can be seen in FIGS. 5 to 7, the first wide blade 20A has multiple male terminals 30A in the form of electrically conductive elongated members arranged in the connector-width direction, shielding plates 40A provided so as to cover the terminal array range, and insulating plates 50A retaining the male terminals 30A and the shielding plates 40A in place via unitary co-molding.

While all the male terminals 30A are fabricated to the same shape, some of the male terminals 30A are used as signal terminals, while other male terminals 30A are used as ground terminals. The male terminals 30A, which are electrically conductive elongated members made by bending metal strips in the through-thickness direction, have arm portions 31A, which extend in a rectilinear configuration in the forward-backward direction (direction of connector insertion and extraction), bend portions 32A, which are bent downwardly at right angles at the rear ends of said arm portions 31A, and leg portions 33A, which are coupled to the arm portions 31A via said bend portions 32A and extend downwardly toward the bottom portion of the housing 10.

As can be seen in FIG. 5 (A) and FIG. 7, the arm portions 31A, which extend in the forward-backward direction along the top face of the hereinafter-described arm-portion insulating plate 50A-1, are secured and retained in place by the arm-portion insulating plate 50A-1 throughout their entire length. As can be seen in FIG. 5 (A) and FIG. 7, most of the top faces (major faces) of said arm portions 31A are exposed on the top face of the arm-portion insulating plate 50A-1, and the top faces (exposed surfaces) of the front end sections of said arm portions 31A are formed as male contact portions 31A-1 placed in contact with the female terminals 120 provided in the female connector 2.

As can be seen in FIG. 5 (A) and FIG. 7, the leg portions 33A, which extend in the up-down direction along the rear face of the hereinafter-described leg-portion insulating plate 50A-2 (face on side X1 in FIG. 5 (A)), are secured and retained in place by the leg-portion insulating plate 50A-2 throughout their entire length. Most of the rear face (major surface) of said leg portions 33A is exposed on the rear face of the leg-portion insulating plate 50A-2. The lower end portions of said leg portions 33A, which are bent at right angles and extend rearwardly (toward side X1), are formed as connecting portions 33A-1 that are solder-connected to the corresponding circuits of the circuit board (not shown).

As can be seen in FIG. 6 (A), the shielding plates 40A have an arm-portion shielding plate 40A-1, which is provided in alignment with the arm portions 31A of the male terminals 30A, and a leg-portion shielding plate 40A-2, which is provided in alignment with the leg portions 33A of the male terminals 30A. The arm-portion shielding plate 40A-1 is provided along the bottom face of the hereinafter-described arm-portion insulating plate 50A-1 and extends across substantially the entire length of the arm portions 31A in the forward-backward direction as well as across the entire terminal array range in the connector-width direction (terminal array direction).

As can be seen in FIG. 5 (B), the leg-portion shielding plate 40A-2 is provided along the front face of the hereinafter-described leg-portion insulating plate 50A-2 (face on side X2 in FIG. 5 (B)) and extends across substantially the entire length of the leg portions 33A in the up-down direction as well as across the entire terminal array range in the connector-width direction (terminal array direction).

In the present embodiment, the arm-portion shielding plate 40A-1 and leg-portion shielding plate 40A-2 have protruding sections protruding on the side facing the male terminals 30A at locations corresponding to said male terminals 30A, which serve as ground terminals, in the connector-width direction, thereby making it possible to establish electrical communication with said male terminals 30A by placing said protruding sections in contact with the above-mentioned male terminals 30A.

As can be seen in FIGS. 5 to 7, the insulating plate 50A has an arm-portion insulating plate 50A-1, which is provided in alignment with the arm portions 31A of the male terminals 30A, and a leg-portion insulating plate 50A-2, which is provided in alignment with the leg portions 33A of the male terminals 30A.

The arm-portion insulating plate 50A-1 is a plate-shaped member made of resin and, as can be seen in FIGS. 5 to 7, extends across substantially the entire length of the arm portions 31A in the forward-backward direction as well as across the entire terminal array range in the connector-width direction (terminal array direction). As can be seen in FIG. 5 (A), said arm-portion insulating plate 50A-1 has formed on its top face, at multiple locations in the forward-backward direction, terminal retaining portions 51A extending throughout the entire range in the connector-width direction. Said terminal retaining portions 51A partially cover the top faces of the arm portions 31A of the male terminals 30A, as a result of which the arm portions 31A are retained in place by the arm-portion insulating plate 50A-1 in a more reliable manner. In the present embodiment, the terminal retaining portion 51A that is second from the front among the multiple terminal retaining portions 51A is positioned in alignment with the front ends of the first resilient engagement pieces 17A-4 of the housing 10 in the forward-backward direction, and the rearmost terminal retaining portion 51A, in other words, 51A at the rear end location of the arm-portion insulating plate 50A-1, is positioned in alignment with the rear end of the first stopper portion 17A-5.

In addition, as can be seen in FIG. 2 and FIG. 5 (A), the arm-portion insulating plate 50A-1 has two front protrusions 52A, which protrude upwardly from the top face of the terminal retaining portion 51A that is second from the front and extend in the connector-width direction, and a single rear protrusion 53A, which protrudes upwardly from the top face of the rearmost terminal retaining portion 51A and extends in the connector-width direction. The two front protrusions 52A are formed at locations corresponding to the front ends (see FIG. 2 and FIG. 4 (A)) of the two first resilient engagement pieces 17A-4 of the housing 10 in the connector-width direction. As can be seen in FIG. 5 (A), the rear protrusion 53A is formed over the entire extent of the arm-portion insulating plate 50A-1 in the connector-width direction and is positioned in alignment with the rear end of the first stopper portion 17A-5 of the housing 10 in the connector-width direction (see FIG. 2 and FIGS. 4 (A) and 4 (B)).

As discussed hereafter, engagement of the front protrusions 52A and the front ends of the first resilient engagement pieces 17A-4 restricts the rearward movement of the arm-portion blade 20A-1 and, consequently, the first wide blade 20A, in excess of a predetermined amount (see FIG. 2). In addition, the rear protrusion 53A is located slightly behind the stopper face 17A-5A (rear end face) of the first stopper portion 17A-5 in a face-to-face relationship with said stopper face 17A-5A and is abuttable against said stopper face 17A-5A from the rear. As a result, the amount of insertion of the arm-portion blade 20A-1 into the first wide holding groove 17A from the rear is restricted.

In addition, the arm-portion insulating plate 50A-1 has formed on its bottom face, at multiple locations in the forward-backward direction, shielding plate retaining portions 54A protruding toward the male terminal 30A side and extending throughout the entire range in the connector-width direction (see FIG. 7). Said shielding plate retaining portions 54A partially cover the bottom face of the arm-portion shielding plate 40A-1, as a result of which the arm-portion shielding plate 40A-1 is retained in place by the arm-portion insulating plate 50A-1 in a more reliable manner. In addition, the arm-portion blade 20A-1 abuts the top face of the upper top partition 18A-1 with these shielding plate retaining portions 54A, thereby impeding contact between the arm-portion blade 20A-1 and the top face of the upper top partition 18A-1 throughout the entire length thereof in the forward-backward direction.

As can be seen in FIG. 2 and FIGS. 5 to 7, the leg-portion insulating plate 50A-2, which is a plate-shaped member made of resin, extends across substantially the entire length of the leg portions 33A in the up-down direction as well as across the entire terminal array range in the connector-width direction (terminal array direction). Said leg-portion insulating plate 50A-2 has formed on its rear face, at multiple locations in the up-down direction, terminal retaining portions 55A extending throughout the entire range in the connector-width direction (see FIG. 7). Said terminal retaining portions 55A partially cover the rear face of the leg portions 33A of the male terminals 30A, as a result of which the leg portions 33A are retained in place by the leg-portion insulating plate 50A-2 in a more reliable manner. In addition, the leg-portion insulating plate 50A-2 has formed on its front face, at multiple locations in the up-down direction, shielding plate retaining portions 56A extending throughout the entire range in the connector-width direction (see FIG. 7). Said shielding plate retaining portions 56A partially cover the front face of the leg-portion shielding plate 40A-2, as a result of which the leg-portion shielding plate 40A-2 is retained in place by the leg-portion insulating plate 50A-2 in a more reliable manner.

In the first wide blade 20A, the arm portions 31A of the multiple male terminals 30A and the arm-portion shielding plate 40A-1 are retained in place by the arm-portion insulating plate 50A-1, and the leg portions 33A of the multiple male terminals 30A and the leg-portion shielding plate 40A-2 are retained in place by the leg-portion insulating plate 50A-2 via unitary co-molding. The thus-fabricated first wide blade 20A is configured such that the arm-portion blade 20A-1, which has arm portions 31A, an arm-portion shielding plate 40A-1, and an arm-portion insulating plate 50A-1 and the leg-portion blade 20A-2, which has leg portions 33A, a leg-portion shielding plate 40A-2, and a leg-portion insulating plate 50A-2, are at right angles to each other and are coupled by the bend portions 32A of the male terminals 30A.

It should be noted that although in the present embodiment said bend portions 32A are adapted to be exposed, said bend portions 32A may alternatively be covered by plastic sections forming an integral part of the arm-portion insulating plate 50A-1 and leg-portion insulating plate 50A-2. In addition, although in the present embodiment the bend portions 32 are bent at a right angle, the bend angle of the bend portions is not limited thereto, and the bend portions may be bent at an acute or obtuse angle.

As can be seen in FIG. 2 and FIGS. 5 to 7, the second wide blade 20B has a configuration obtained by making the arm-portion blade 20A-1 of the first wide blade 20A shorter in the forward-backward direction as well as making the leg-portion blade 20A-2 shorter in the up-down direction. In other words, the insulating plates 50B-1, 50B-2, shielding plates 40B-1, 40B-2, leg portions 33B, and arm portions 31B of the male terminals 30B of the second wide blade 20B are respectively shorter than the insulating plates 50A-1, 50A-2, shielding plates 40A-1, 40A-2, leg portions 33A, and arm portions 31A of the male terminals 30A of the first wide blade 20A.

As can be seen in FIG. 2 and FIGS. 5 to 7, the third wide blade 20C has a configuration obtained when the arm-portion blade 20B-1 of the second wide blade 20B is shortened in the forward-backward direction and inverted in the up-down direction, and the leg-portion blade 20B-2 is shortened in the up-down direction and inverted in the forward-backward direction. In other words, the insulating plates 50C-1, 50C-2, shielding plates 40C-1, 40C-2, leg portions 33C, and arm portions 31C of the male terminals 30C of the third wide blade 20C are respectively shorter than the insulating plates 50B-1, 50B-2, shielding plates 40B-1, 40B-2, leg portions 33B, and arm portions 31B of the male terminals 30B of the second wide blade 20B. In addition, said third wide blade 20C differs from the second wide blade 20B in that, while the connecting portions 33B-1 of the male terminals 30B of the second wide blade 20B extend rearwardly, the connecting portions 33C-1 of its male terminals 30C extend forwardly.

The fourth wide blade 20D has a configuration obtained by making the arm-portion blade 20C-1 of the third blade 20C shorter in the forward-backward direction as well as making the leg-portion blade 20C-2 shorter in the up-down direction. In other words, the insulating plates 50D-1, 50D-2, shielding plates 40D-1, 40D-2, leg portions 33D, and arm portions 31D of the male terminals 30D of the fourth wide blade 20D are respectively shorter than the insulating plates 50C-1, 50C-2, shielding plates 40C-1, 40C-2, leg portions 33C, and arm portions 31C of the male terminals 30C of the third wide blade 20C.

The configuration of the narrow blades 60A to 60D will be described below. The configuration of the respective components of the narrow blades 60A to 60D will be described with emphasis on its differences from that of the wide blades 20A to 20D, by assigning thereto reference numerals obtained by adding "40" to the reference numerals of the corresponding sections in said wide blades 20A to 20D.

As discussed before, the narrow blades 60A to 60D, as can be seen in FIG. 5 and FIG. 6, are configured by making the wide blades 20A to 20D smaller in the connector-width direction. In addition, the narrow blades 60A to 60D are not provided with shielding plates, and, in this respect, their configuration is different from that of the wide blades 20A to 20D, which have shielding plates.

As can be seen in FIG. 5, FIG. 6, and FIG. 8, in the narrow blades 60A to 60D, the side opposite to the terminal array face of the arm-portion blades 60A-1 to 60D-1 and the side opposite to the terminal array face of the leg-portion blades 60A-2 to 60D-2 are major faces formed by the insulating plates. In addition, projections 94A to 94D, 96A to 96D protruding from the major faces of said insulating plates 90A-1 to 90D-2 are formed on said major faces instead of the shielding plate retaining portions 54A to 54D, 56A to 56D. In addition, in the narrow blades 60A to 60B, one front protrusion 92A to 92D is provided on each arm-portion insulating plate 90A-1 to 90D-1, and, in this respect, they differ from the wide blades 20A to 20B, in which two front protrusions 52A to 52D are provided.

Furthermore, at both ends in the width direction (Y-axis direction) of the narrow blades 60A to 60D, the front protrusions 92A to 92D have formed therein reinforcing portions 92A-1 to 92D-1 projecting further to the rear than other portions (see FIG. 5, FIG. 6 and FIG. 8), with said reinforcing portions 92A-1 to 92D-1 providing an improvement in the strength of the front protrusions 92A to 92D.

In addition, as can be seen in FIG. 5, FIG. 6, and FIG. 8, the leg-portion blade 60B-2 of the second narrow blade 60B has cutouts made and notched portions 97B formed at both ends of the leg-portion insulating plate 90B-2 in the connector-width direction (Y-axis direction) at intermediate locations in the up-down direction. Said notched portions 97B are formed in the up-down direction throughout a range that includes the rear blade-restricting portion 17K of the male housing 10. Accordingly, as described hereafter, when said second narrow blade 60B is mounted to the male housing 10 from the rear, said notched portions 97B help prevent the leg-portion blade 60B-2 from interfering with the rear blade-restricting portion 17K (see FIG. 8).

In addition, said notched portions 97B do not reach the location of the front blade-restricting portion 17J in the up-down direction. Consequently, when the second narrow blade 60B is mounted, the front blade-restricting portion 17J does not pass through the notched portion 97B from the front and is positioned in a manner permitting abutment against the front face of the leg-portion blade 60B-2 of the second narrow blade 60B (see FIG. 8).

In addition, as can be seen in FIG. 5, FIG. 6, and FIG. 8, the leg-portion blade 60C-2 of the third narrow blade 60C has cutouts made and notched portions 97C formed at both ends of the leg-portion insulating plate 90B-2 in the connector-width direction (Y-axis direction) at intermediate locations in the up-down direction. Said notched portions 97C are formed in the up-down direction throughout a range that includes the blade-restricting portions 17J, 17K of the male housing 10. Accordingly, as described hereafter, when the third narrow blade 60C is mounted to the male housing 10 from the rear, said notched portions 97C help prevent the leg-portion blade 60C-2 from interfering with the blade-restricting portions 17J, 17K (see FIG. 8).

[Assembly of Male Connector]

The assembly of the male connector 1 will be described next. The male connector 1 is assembled by mounting the four types of wide blades 20A to 20D and the four types of narrow blades 60A to 60D to the housing 10 from the rear. At such time, the wide blades 20A to 20D are mounted successively as follows, i.e., the fourth wide blade 20D, the third wide blade 20C, the second wide blade 20B, and the first wide blade 20A, and the narrow blades 60A to 60D are mounted successively as follows, i.e., the fourth narrow blade 60D, the third narrow blade 60C, the second narrow blade 60B, and the first narrow blade 60A.

First, the mounting members 100 are attached to the mounting portions 13A of the housing 10 (see FIG. 1) by press-fitting from above. The mounting of the mounting members 100 may be performed either after the mounting of the wide blades 20A to 20D and narrow blades 60A to 60D, or simultaneously therewith. In addition, the mounting members 100 may be mounted by press-fitting from below or mounted by unitary co-molding with the housing 10.

Next, the arm-portion blade 20D-1 of the fourth wide blade 20D is inserted into the fourth wide holding groove 17D by moving it forwardly along the bottom face of the lower bottom partition 18C-2 of the housing 10. At such time, the lateral edge portions on both sides of the arm-portion blade 20D-1 (its ends in the connector-width direction) enter the guiding groove 17D-3 from the rear. Within said guiding groove 17D-3, the up-down movement of the lateral edge portions of the arm-portion blade 20D-1 is restricted by the upper interior wall surface (bottom face of the guiding projection 17D-2) and the lower interior wall surface (top face of the bottom wall 12) of said guiding groove 17D-3, and its movement in the connector-width direction is restricted by the lateral interior wall surfaces (the interior wall surface of the lateral walls 13 and the wall surface of the intermediate wall 10E).

Thus, the inclined orientation of the arm-portion blade 20D-1 about an axial line (imaginary line) extending in the connector-width direction on the major face of said arm-portion blade 20D-1 when viewed in the connector-width direction (Y-axis direction) is minimized by restricting the up-down movement of the lateral edge portions of the arm-portion blade 20D-1, as a result of which the major faces of said arm-portion blade 20D-1 can be readily stabilized in an orientation parallel to the mounting face of the circuit board. In addition, the inclined orientation of the arm-portion blade 20D-1 about an axial line (imaginary line) extending in the up-down direction when viewed in the up-down direction (Z-axis direction) is minimized by restricting the movement of the lateral edge portions of the arm-portion blade 20D-1 in the connector-width direction, as a result of which the blade can be readily stabilized in an orientation extending in the forward-backward direction. This facilitates the operation of insertion of the arm-portion blade 20D-1 into the fourth wide holding groove 17D of the housing 10.

In the process of insertion of the arm-portion blade 20D-1, the front protrusions 52D of said arm-portion blade 20D-1 abut the fourth resilient engagement pieces 17D-4 and cause said fourth resilient engagement pieces 17D-4 to undergo downward elastic deformation, thereby permitting further insertion of the arm-portion blade 20D-1.

Furthermore, when the arm-portion blade 20D-1 is inserted and the front protrusions 52D reach a location forward of the front ends of the fourth resilient engagement pieces 17D-4, said fourth resilient engagement pieces 17D-4 return to a free state. As a result, as can be seen in FIG. 2, the front ends of the fourth resilient engagement pieces 17D-4 engage the front protrusions 52D from behind said front protrusions 52D, thereby obstructing the rearward movement of the arm-portion blade 20D-1 and, consequently, the fourth wide blade 20D.

In addition, at such time, the rear protrusion 53D of the arm-portion blade 20D-1 is positioned slightly behind the stopper face 17D-5A (rear end face) of the stopper portion 17D-5 in a manner permitting abutment against said stopper face 17D-5A. Therefore, even if the arm-portion blade 20D-1 were inserted to an excessive extent, the rear protrusion 53D abuts the stopper face 17D-5A from the rear, thereby restricting further forward movement, as a result of which it becomes possible to easily place the arm-portion blade 20D-1 at the normal location.

Next, the same procedure as during the above-described mounting of the fourth wide blade 20D is used to mount the wide blades 20C, 20B, and 20A to the housing 10 by inserting the arm-portion blade 20C-1 of the third wide blade 20C, the arm-portion blade 20B-1 of the second wide blade 20B, and the arm-portion blade 20A-1 of the first wide blade 20A into, respectively, the third wide holding groove 17C, second wide holding groove 17B, and first wide holding groove 17A from the rear.

In addition, due to the fact that in the present embodiment the rear protrusion 53A in the first wide blade 20A extends over the entire extent of the arm-portion blade 20A-1 in the connector-width direction, once the first wide blade 20A is attached to the housing 10, the rear protrusion 53A has its central portion in the connector-width direction facing the stopper face 17A-5A of the first stopper portion 17A-5, and, at the same time, both ends in the connector-width direction facing the rear end face of the guiding projection 17A-2, thereby restricting over-insertion of the arm-portion blade 20A-1.

Once the wide blades 20A to 20D are mounted to the housing 10, said wide blades 20A to 20D are retained in place in the housing 10 in a state in which the arm-portion blades 20A-1 to 20D-1 are positioned successively in the up-down direction, and the leg-portion blades 20A-2 to 20D-2 are positioned successively in the forward-backward direction at spaced intervals. In addition, as can be seen in FIG. 2, the connecting portions 33A-1 to 33D-1 of the male terminals 30A to 30D of the blades 20A to 20D are positioned below the bottom face of the bottom wall 12 of the housing 10.

Next, the same procedure as during the above-described mounting of the wide blades 20A to 20D is used to mount the narrow blades 60A to 60D to the housing 10 by inserting the arm-portion blade 60D-1 of the fourth narrow blade 60D, the arm-portion blade 60C-1 of the third narrow blade 60C, the arm-portion blade 60B-1 of the second narrow blade 60B, and the arm-portion blade 60A-1 of the first narrow blade 60A into, respectively, the fourth narrow holding groove 17H, the third narrow holding groove 17G, the second narrow holding groove 17F, and the first narrow holding groove 17E from the rear.

In the same manner as with the previously described wide blades 20A to 20D, when the arm-portion blades 60A-1 to 60D-1 of the narrow blades 60A to 60D are inserted, the lateral edge portions on both sides of the arm-portion blades 60A-1 to 60D-1 are restricted from movement within the guiding grooves 17E-3 to 17H-3 in the up-down and connector-width directions, as a result of which the orientation of said arm-portion blades 60A-1 to 60D-1 is stabilized, thereby facilitating the operation of insertion of the arm-portion blades 60A-1 to 60D-1 into the narrow holding grooves 17E to 17H.

As discussed before, in the present embodiment, notched portions 97C are formed in the leg-portion blade 60C-2 of the third narrow blade 60C at locations corresponding to the blade-restricting portions 17J, 17K of the housing 10. Therefore, when the arm-portion blade 60C-1 of said third narrow blade 60C is inserted, the blade-restricting portions 17J, 17K do not interfere with the leg-portion blade 60C-2 and, for this reason, the arm-portion blade 60C-1 can be inserted all the way to the normal position without difficulty.

In addition, as discussed before, in the present embodiment, notched portions 97B are formed in the leg-portion blade 60B-2 of the second narrow blade 60B at a location corresponding to the rear blade-restricting portion 17K of the housing 10. Therefore, when the arm-portion blade 60B-1 of said second narrow blade 60B is inserted, the rear blade-restricting portion 17K does not interfere with the leg-portion blade 60B-2, and, for this reason, the arm-portion blade 60B-1 can be inserted all the way to the normal position without difficulty.

In addition, after mounting of the narrow blades 60A to 60D to the housing 10, the rear protrusions 93A to 93D of the arm-portion blades 60A-1 to 60D-1 are in a face-to-face relationship with the rear end faces of the guiding projections 17E-2 to 17H-2, thereby restricting over-insertion of the arm-portion blades 60A-1 to 60D-1. In addition, the leg-portion blade 60A-2 of the first narrow blade 60A is located in a face-to-face relationship with the rear end face of the rear blade-restricting portion 17K at both ends thereof. The leg-portion blade 60B-2 of the second narrow blade 60B is located in a face-to-face relationship with the rear end face of the front blade-restricting portion 17J at both ends thereof.

Once the narrow blades 60A to 60D are mounted to the housing 10, said narrow blades 60A to 60D are retained in place in the housing 10 in a state in which the arm-portion blades 60A-1 to 60D-1 are positioned successively in the up-down direction, and the leg-portion blades 60A-2 to 60D-2 are positioned successively in the forward-backward direction at spaced intervals. In addition, as can be seen in FIG. 3, the connecting portions 73A-1 to 73D-1 of the male terminals 70A to 70D of the respective blades 60A to 60D are positioned below the bottom face of the bottom wall 12 of the housing 10.

[Mounting of Male Connector]

The male connector 1 according to the present embodiment is mounted to the mounting face of the circuit board in the following manner. First, the male connector 1 is arranged such that the bottom wall 12 of the housing 10 is in a face-to-face relationship with the mounting face of the circuit board and the connecting portions 33A-1 to 33D-1 and 73A-1 to 73D-1 of the respective blades 20A to 20D and 60A to 60D are disposed on the corresponding circuits of the mounting face. Next, the male connector 1 and the circuit board are placed in a reflow oven and heated in said reflow oven heating, thereby mounting the connecting portions 33A-1 to 33D-1 and 73A-1 to 73D-1 via solder-connection to the above-mentioned corresponding circuits.

In the present embodiment, as discussed before, the narrow blades 60A to 60D are not provided with shielding plates, so when the male connector 1 is heated in the reflow oven, the arm-portion blades 60A-1 to 60D-1 and leg-portion blades 60A-2 to 60D-2 are prone to deformation by warping in the through-thickness direction thereof due to differences in the coefficients of thermal expansion between the arm portions 71A to 71D of the metal male terminals 70A to 70D and the plastic arm-portion insulating plates 90A-1 to 90D-1, as well as between the leg portions 73A to 73D of the metal male terminals 70A to 70D and the plastic leg-portion insulating plates 90A-2 to 90D-2. This deformation causes the arm-portion blades 60A-1 to 60D-1 and leg-portion blades 60A-2 to 60D-2 to be displaced toward the side opposite to the array face side of the male terminals 70. When such a displacement of the leg-portion blades 60A-2 to 60D-2 takes place, the connecting portions 73A-1 to 73D-1 of the male terminals 70A to 70D are lifted upwardly, in other words, in a direction away from the corresponding circuits of the circuit board, resulting in defective connections to said corresponding circuits.

Since in the present embodiment the lateral edge portions of the arm-portion blades 60A-1 to 60D-1 are located within the guiding grooves 17E-3 to 17H-3, displacement in the through-thickness direction, in other words, in the up-down direction, of the arm-portion blades 60A-1 to 60D-1 is restricted by the upper interior wall surfaces and lower interior wall surfaces of the guiding grooves 17E-3 to 17H-3.

In addition, the blade-restricting portions 17K, 17J of the housing 10 are located in front of the lateral edge portions of the leg-portion blades 60A-2, 60B-2 in a manner permitting abutment against each of said leg-portion blades 60A-2, 60B-2. Accordingly, forward displacement of the leg-portion blades 60A-2, 60B-2 is restricted by abutment against the blade-restricting faces 17K-1, 17J-1 of the blade-restricting portions 17K, 17J. As a result, the connecting portions 73A-1, 73B-1 of the male terminals 70A, 70B are not liable to be lifted and it becomes possible to reliably solder-connect said connecting portions 73A-1, 73B-1 to the corresponding circuits on the circuit board.

In addition, even if external forces due to inadvertent impacts and the like act on the leg-portion blades 60A-2, 60B-2 from the rear after mounting on the circuit board, the forward displacement of said leg-portion blades 60A-2, 60B-2 is restricted by abutment against the blade-restricting portions 17K, 17J. As a result, an excellent state of connection is maintained between the connecting portions 73A-1, 73B-1 and the corresponding circuits of the circuit board.

It should be noted that as far as the leg-portion blades 60C-2, 60D-2 of the narrow blades 60C, 60D used in the present embodiment are concerned, since the dimensions of said leg-portion blades 60C-2, 60D-2 in the up-down direction are small and, therefore, the degree of heating-induced deformation is low and its effects on the state of connection of the connecting portions 73A-1 to 73D-1 is small, there is no need to provide sections restricting the displacement of said leg-portion blades 60C-2, 60D-2 in the housing 10.

In addition, in the wide blades 20A to 20D, in each of the arm-portion blades 20A-1 to 20D-1 and leg-portion blades 20A-2 to 20D-2, there are metallic arm-portion shielding plates 40A-1 to 40D-1 and leg-portion shielding plates 40A-2 to 40D-2 provided on the major faces of the sides opposite to the array face of the arm portions 31A to 31D and leg portions 33A to 33D of the male terminals 30A to 30D, and, therefore, the above-described deformation is not liable to occur.

Although the present embodiment has described an example of restricting the forward displacement of the leg-portion blades 60A-2, 60B-2 of the narrow blades 60A, 60B, if it is understood in advance that said leg-portion blades will be displaced in a rearward direction during heating, such rearward displacement of said leg-portion blades may be restricted by forming, within the holding portions of the housing, blade-restricting portions located behind the leg-portion blades in a face-to-face relationship with the rear faces of said leg-portion blades.

The blade-restricting portions that restrict the rearward displacement of the leg-portion blades can be formed in a variety of shapes. For example, the blade-restricting portions can be formed as resilient pieces having a latching capability and equipped with protrusions that extend forwardly (in the direction of blade insertion) along said interior wall surface and protrude from the above-mentioned interior wall surface at the front ends thereof by cutting out portions of the interior wall surface of the holding portions of the housing (surface perpendicular to the connector-width direction). Thus, if the blade-restricting portions are formed as resilient pieces, when the blades are installed in the housing from the rear, both lateral edge portions of the leg-portion blades will abut the corresponding protrusions and cause the above-mentioned resilient pieces to undergo resilient deformation so as to widen in the connector-width direction under pressure. In addition, if the leg-portion blades travel forward and move past the location of the above-mentioned protrusions, the above-mentioned resilient pieces will return to a free state and, as a result, the above-mentioned protrusions will be positioned behind the leg-portion blades in a face-to-face relationship with the rear faces of the leg-portion blades. As a result, the rearward displacement of the leg-portion blades will be restricted by the above-mentioned protrusions.

[Female Connector Configuration]

Next, the configuration of the female connector 2 will be described with reference to FIGS. 1 to 3. Said female connector 2 is mated with the male connector 1 in the rearward direction (X1 direction). Said female connector 2 has a rectangular parallelepiped-shaped housing 110 adapted for the guiding portion of the male connector 1, multiple female terminals 120 serving as counterpart terminals retained in place in array form in said housing 110, and mounting members 130 retained in place on said housing 110.

As can be seen in FIG. 1, the housing 110 has four terminal retaining walls 111A to 111D, which have major faces perpendicular to the up-down direction and extend in the connector-width direction; two lateral walls 112, which have major faces perpendicular to said connector-width direction, extend in the up-down direction, and couple the ends of the above-mentioned four terminal retaining walls 111A to 111D in the connector-width direction; and an intermediate wall 113, which is parallel to said lateral walls 112, extends in the up-down direction at an intermediate location in the connector-width direction, and couples the above-mentioned four terminal retaining walls 111A to 111D.

The terminal retaining walls 111A to 111D, which are disposed from top to bottom in parallel to one another, are provided in alignment with the wide blades 20A to 20D and narrow blades 60A to 60D of the male connector. Below, when it is necessary to distinguish the terminal retaining walls 111A to 111D, the walls are referred to respectively as the "first terminal retaining wall 111A", "second terminal retaining wall 111B", "third terminal retaining wall 111C", and "fourth terminal retaining wall 111D".

In the first terminal retaining wall 111A, which is the top wall of the housing 110, there are formed terminal retaining grooves 111A-1 (see FIG. 2 and FIG. 3) used to retain the female terminals 120 in place. The grooves, which are recessed from the bottom face and extend in the forward-backward direction, are formed in array form in the connector-width direction. In the second terminal retaining wall 111B, in the same manner as in the above-described first terminal retaining wall 111A, there are formed terminal retaining grooves 111B-1 used to retain the female terminals 120 in place. The grooves, which are recessed from the bottom face and extend in the forward-backward direction, are formed in array form in the connector-width direction.

The third terminal retaining wall 111C, which has a configuration that is obtained by vertically flipping the above-described second terminal retaining wall 111B, has terminal retaining grooves 111C-1 formed in array form on its top face. The fourth terminal retaining wall 111D, which constitutes the bottom wall of the housing 110 and has a configuration that is obtained by vertically flipping the above-described first terminal retaining wall 111A, has terminal retaining grooves 111D-1 formed in array form on its top face.

Mounting portions 112A, which protrude outwardly in the connector-width direction, are provided extending in the up-down direction in the front portion of the lateral walls 112 (side Y2 in FIG. 1 and side X2 in FIG. 2 and FIG. 3), and mounting members 130 made of sheet metal material are provided in said mounting portions 112A protruding forwardly of the front end face of the housing 110. The intermediate wall 113 extends throughout the entire extent of the housing 110 in the up-down and forward-backward directions at a location closer to the X2 side in the connector-width direction (in the X-axis direction in FIG. 1) in alignment with the intermediate wall 10E of the male connector 1, thereby dividing the guiding portion in two in the connector-width direction. The guiding portion of the female connector 2 is connected to the wide blades 20A to 20D of the male connector 1 in the region located closer to the X1 side than the intermediate wall 113 in the connector-width direction in FIG. 1 (hereinafter referred to as the "female-side wide mating area"), and is connected to the narrow blades 60A to 60D of the male connector 1 in a section located closer to the X2 side than the intermediate wall 113 (hereinafter referred to as the "female-side narrow mating area").

In the female-side wide mating area, between the first terminal retaining wall 111A and the second terminal retaining wall 111B, the housing 110 has formed therein an upper wide blade-receiving space 114A that extends along the bottom face of said first terminal retaining wall 111A and is intended to receive the front end portion of the first wide blade 20A of the male connector 1, and, below said upper wide blade-receiving space 114A, has formed therein a female-side upper wide mating area corresponding to the male-side upper wide mating area of the male connector 1. In said female-side upper wide mating area, there are formed an upper block portion 115A, which protrudes upwardly from the top face of the second terminal retaining wall 111B in the central area of said female-side upper wide mating area in the connector-width direction and extends in the forward-backward direction; an upper guided portion 116A, which constitutes a space extending in the forward-backward direction (Y-axis direction) on the X1 side in the connector-width direction from the outside of said upper block portion 115A in the connector-width direction; and an upper restricted portion 117A, which constitutes a space extending in the forward-backward direction on the X2 side of said upper block portion 115A in the connector-width direction.

The lateral face of the upper block portion 115A on the X1 side in the connector-width direction is a restricted face that abuts a lateral face of the upper wide guiding portion 14A of the male connector 1 and is restricted from moving in the connector-width direction when the connector is in a mated state.

The upper guided portion 116A is a space that receives and holds the upper wide guiding portion 14A of the male connector 1 from the rear when the connector is in a mated state. The interior wall surface of the lateral wall 112 that forms said upper guided portion 116A is a restricted face that abuts a lateral face of the upper wide guiding portion 14A and is restricted from moving in the connector-width direction.

The upper restricted portion 117A is a space that receives and holds the upper restricting portion 15A of the male connector 1 from the rear when the connector is in a mated state. The lateral face of the intermediate wall 113 forming said upper restricted portion 117A is a restricted face that abuts the lateral face of the above-mentioned upper restricting portion 15A and is restricted from moving in the connector-width direction.

A middle wide blade-receiving space 114B, which is intended to receive the respective front end sections of the second wide blade 20B, third wide blade 20C, and middle partition 18B of the male connector 1, is formed between the second terminal retaining wall 111B and the third terminal retaining wall 111C in the female-side wide mating area.

A lower wide blade-receiving space 114C, which extends along the top face of said fourth terminal retaining wall 111D and is intended to receive the front end portion of the fourth wide blade 20D of the male connector 1, and, above said lower wide blade-receiving space 114C, a female-side lower wide mating area, which corresponds to the male-side lower wide mating area of the male connector 1, are formed between the third terminal retaining wall 111C and the fourth terminal retaining wall 111D in the female-side wide mating area. A lower block portion 115B, which protrudes downwardly from the bottom face of the third terminal retaining wall 111C in the central area of said female-side lower wide mating area in the connector-width direction and extends in the forward-backward direction, a lower guided portion 116B, which constitutes a space extending in the forward-backward direction on the X1 side of said lower block portion 115B in the connector-width direction, and a lower restricted portion 117B, which constitutes a space extending in the forward-backward direction on the X2 side of said lower block portion 115B in the connector-width direction, are formed in said female-side lower wide mating area.

Although the lower block portion 115B has a configuration that is obtained by vertically flipping the upper block portion 115A, its shape differs in that its dimensions in the connector-width direction are smaller than those of the upper block portion 115A.

While the shape of the lower guided portion 116B and the lower restricted portion 117B are respectively obtained by vertically flipping the upper guided portion 116A and the upper restricted portion 117A, their shapes differ in that their dimensions in the connector-width direction are larger than those of said upper guided portion 116A and upper restricted portion 117A to the same extent that the lower block portion 115B is narrower in width as discussed above.

In the female-side narrow mating area, between the first terminal retaining wall 111A and the second terminal retaining wall 111B, the housing 110 has formed therein an upper narrow blade-receiving space 114D that extends along the bottom face of said first terminal retaining wall 111A and is intended to receive the front end portion of the first narrow blade 60A of the male connector 1, and, below said upper narrow blade-receiving space 114D, has formed therein a female-side upper narrow mating area corresponding to the male-side upper narrow mating area of the male connector 1. In said female-side upper narrow mating area, there is formed an upper guided portion 116C that constitutes a space extending in the forward-backward direction (Y-axis direction).

A middle narrow blade-receiving space 114E, which is intended to receive the respective front end sections of the second narrow blade 60B, third narrow blade 60C, and the middle partition 18B of the male connector 1, is formed between the second terminal retaining wall 111B and the third terminal retaining wall 111C in the female-side narrow mating area.

A lower narrow blade-receiving space 114F, which extends along the top face of the fourth terminal retaining wall 111D and is intended to receive the front end portion of the fourth narrow blade 60D of the male connector 1, and, above said lower narrow blade-receiving space 114F, a female-side lower narrow mating area, which corresponds to the male-side lower narrow mating area of the male connector 1, are formed between the third terminal retaining wall 111C and said fourth terminal retaining wall 111D in the female-side narrow region. In said female-side lower wide mating area, there is formed a lower guided portion 116D that constitutes a space extending in the forward-backward direction.

The female terminals 120 are provided divided into a total of eight group of terminals, with four groups of terminals in the up-down direction and two groups of terminals in the connector-width direction, in alignment with the wide blades 20A to 20D and narrow blades 60A to 60B of the male connector, and are press-fitted into the respective terminal retaining grooves 111A-1 to 111D-1 of the terminal retaining walls 111A to 111D from the front and retained therein. The multiple female terminals 120 of each respective terminal group include signal terminals and ground terminals. In each respective terminal group, said signal terminals and said ground terminals are arranged in an order corresponding to the signal terminals and ground terminals of the male connector 1. In the present embodiment, whenever it is necessary to distinguish the female terminals 120 of each terminal group for ease of discussion, said female terminals 120, starting from the topmost terminal group in the female-side wide mating area, are referred to as the "first female terminals 120A", "second female terminals 120B", "third female terminals 120C", and "fourth female terminals 120D", and furthermore, starting from the topmost terminal group in the female-side narrow mating area, as the "first female terminals 120E", "second female terminals 120F", "third female terminals 120G", and "fourth female terminals 120H". In addition, the letters "A" to "H" are also respectively attached to each part of the female terminals 120.

As can be seen in FIG. 2 and FIG. 3, the female terminals 120, which are fabricated by bending metal strip-like pieces in the through-thickness direction, have a resilient arm portion 121, which extends in the forward-backward direction, a retained portion 122, which is a continuation of said resilient arm portion 121 and is retained by press-fitting in the front portion of the housing 110, and a connecting portion 123, which is bent and extends at a right angle at the front end of said retained portion 122 (end on the X2 side in FIG. 2 and FIG. 3), and which is solder-connected to corresponding circuits on a circuit board (not shown).

The resilient arm portions 121A to 121H are resiliently deformable in the through-thickness direction (up-down direction in FIG. 2 and FIG. 3), and female contact portions 121A-1 to 121H-1 resiliently contactable with the male terminals 30A to 30D of the connector 1 are formed by bending in their free end portions. Specifically, as can be seen in FIG. 2 and FIG. 3, the female contact portions 121A-1, 121B-1, 121E-1, and 121F-1 of the resilient arm portions 121A, 121B, 121E, and 121F are formed to protrude downwardly, and the female contact portions 121C-1, 121D-1, 121G-1, and 121H-1 of the resilient arm portions 121C, 121D, 121G, and 121H are formed to protrude upwardly.

As can be seen in FIG. 3, the connecting portions 123A to 123H are positioned forwardly of the front face of the housing 110 (on the X2 side in FIG. 2 and FIG. 3), with the connecting portions 123A, 123B, 123E, and 123F extending upwardly and the connecting portions 123C, 123D, 123G, and 123H extending downwardly.

The mounting members 130, which are used to fixedly mount the female connector 2 to a circuit board, are made of sheet metal material and, as can be seen in FIGS. 1 to 3, are retained in place by the mounting portions 112A of the lateral walls 112 of the housing 110 so as to protrude forwardly of the front face of the housing 110.

The thus-configured female connector 2 is mounted to a circuit board by disposing it on a mounting face of a circuit board (not shown), solder-connecting the respective connecting portions 123A to 123H of the female terminals 120A to 120H to the corresponding circuits of the circuit board and, at the same time, solder-connecting the mounting members 130 to the corresponding portions of the circuit board.

[Connector Mating Operation]

The operation of mating the male connector 1 and the female connector 2 will be described below. First, the male connector 1 and the female connector 2 are respectively mounted to the mounting faces of the corresponding circuit boards in accordance with the previously described procedure. Then, as can be seen in FIG. 2 and FIG. 3, the guiding portion of the female connector 2 is placed in a face-to-face relationship with the guiding portion of the male connector 1 at a location forward of the male connector 1.

Next, as indicated by arrows in FIGS. 1 to 3, the female connector 2 is moved rearwardly toward the male connector 1 and the guiding portion of the female connector 2 is mated with the guiding portion of the male connector 1. Specifically, first, the female connector 2 is guided toward the regular mating position as the corresponding guiding portions 14A, 14B of the male connector 1 enter the guided portions 116A, 116B of the female connector 2 from the rear.

In addition, when the connectors are mated, the restricted faces of the block portions 115A, 115B of the female connector 2 abut the corresponding restricting faces of the guiding portions 14A, 14B of the male connector 1, the restricted faces of the guided portions 116A, 116B of the female connector 2 abut the corresponding restricting faces of the guiding portions 14A, 14B of the male connector 1, and the restricted faces of the restricted portions 117A, 117B of the female connector 2 abut the restricting faces of the corresponding restricting portions 15A, 15B of the male connector 1, as a result of which the movement of the female connector 2 in the connector-width direction is restricted and the connector is maintained in the regular mating position.

When connector mating is performed in the regular mating position, the front end section of the arm-portion blade 20A-1 of the first wide blade 20A of the male connector 1 enters the upper wide blade-receiving space 114A of the female connector 2 from the rear. In addition, the respective front end sections of the wide blades 20B, 20C and the middle partition 18B of the male connector 1 enter the middle wide blade-receiving space 114B of the female connector 2 from the rear. Further, the front end section of the arm-portion blade 20D-1 of the fourth wide blade 20D is inserted into the lower wide blade-receiving space 114C of the female connector 2.

In addition, the front end section of the arm-portion blade 60E-1 of the first narrow blade 60E of the male connector 1 enters the upper narrow blade-receiving space 114D of the female connector 2 from the rear. Further, the respective front end sections of the middle partition 18B and the arm-portion blades 60E-1 and 60G-1 of the narrow blades 60F, 60G of the male connector 1 enter the middle narrow blade-receiving space 114E of the female connector 2 from the rear. Further, the front end section of the arm-portion blade 60H-1 of the fourth narrow blade 60H is inserted into the lower narrow blade-receiving space 114F of the female connector 2.

As a result, the male contact portions 31A-1 to 31D-1 and 71A-1 to 71D-1 of the male terminals 30A to 30D and 70A to 70D of the arm-portion blades 20A-1 to 20D-1 and 60A-1 to 60D-1 respectively abut the female contact portions 121A-1 to 121H-1 of the resilient arm portions 121A to 121H of the corresponding female terminals 120A to 120H and cause said resilient arm portions 121A to 121H to undergo resilient deformation while coming into contact with said female contact portions 121A-1 to 121H-1 under contact pressure to establish electrical communication, thereby completing the operation of connector mating.

Although the present embodiment has described a connector holding multiple blades, the present invention is also applicable to a connector holding a single blade.

DESCRIPTION OF THE REFERENCE NUMERALS

1 Male connector
2 Female connector

10 Housing
10F Guiding portion
10G Blade holding portion (holding portion)
17A-1 to 17H-1 Guiding portions
17A-3 to 17H-3 Guiding grooves
17A-5 to 17D-5 Stopper portions
17J Front blade-restricting portion (restricting portion)
17K Rear blade-restricting portion (restricting portion)
20A to 20D Wide blades
20A-1 to 20D-1 Arm-portion blades
20A-2 to 20D-2 Leg-portion blades
30A to 30D Male terminals (electroconductive elongated members)
31A to 31D Arm portions
31A-1 to 31D-1 Male contact portions
33A to 33D Leg portions
33A-1 to 33D-1 Connecting portions
50A to 50D Insulating plates
53A to 53D Rear protrusions
60A to 60D Narrow blades
60A-1 to 60D-1 Arm-portion blades
60A-2 to 60D-2 Leg-portion blades
70A to 70D Male terminals
71A to 71D Arm portions
71A-1 to 71D-1 Male contact portions
90A to 90D Insulating plates
93A to 93D Rear protrusions
120A to 120H Female terminals

The invention claimed is:

1. A right-angle electrical connector comprising:

a guiding portion configured to insert and extract a counterpart connector formed in a front portion of a housing holding blades that retain multiple electroconductive elongated members in place in array form by insulating plates, and has a mounting surface for mounting to a circuit board on a bottom face of the housing making an angle to a front face of said housing, and in which the electroconductive elongated members retained in place by the insulating plates have arm portions extending in a rectilinear configuration in a forward-backward direction along a direction of connector insertion and extraction, and leg portions coupled to the rear ends of said arm portions via bend portions and extending downwardly toward the bottom portion, the arm portions comprising contact portions configured to corresponding terminals in a counterpart connector formed in the front end portions thereof, wherein the leg portions have connecting portions solder-connected to corresponding circuits on a circuit board formed at the lower ends thereof, wherein the blades are formed such that the portions of the electroconductive elongated members are retained in place by the insulating plates, the housing has formed therein holding portions allowing for the blades to be inserted from the rear, said holding portions have formed therein guiding portions guiding the insertion of the blades from the rear by guiding grooves extending in the forward-backward direction, and movement of the blades in an up-down direction within the guiding grooves is restricted;

wherein there is provided multiple types of the blades and, in said multiple types of blades, the arm portions and the leg portions of the electroconductive elongated members of the multiple types of blades are set to different lengths such that the arm portions of the electroconductive elongated members are positioned successively so as to be spaced apart from one another in an up-down direction and the leg portions of the electroconductive elongated members are positioned similarly in the forward-backward direction.

2. The right-angle electrical connector according to claim 1, wherein the guiding portions are formed at both ends of the holding portions in the array direction of the electroconductive elongated members, and movement of the blades in the above-mentioned array direction within the guiding grooves of said guiding portions is restricted.

3. The right-angle electrical connector according to claim 1, wherein a plurality of the holding portions are formed in alignment with the multiple types of blades.

4. The right-angle electrical connector according to claim 1 wherein the blades have formed therein protrusions projecting from the major faces of the insulating plates and the amount of insertion of the from the rear into the above-mentioned holding portions is restricted by said protrusions.

5. The right-angle electrical connector according to claim 1, wherein the holding portions have formed therein stopper portions used to restrict the amount of insertion of the blades from the rear at locations different from the guiding portions in the array direction, and the above-mentioned protrusions are abuttable against the rear faces of said stopper portions at locations corresponding to the stopper portions in the above-mentioned array direction.

6. The right-angle electrical connector according to claim 5, wherein the stopper portions are formed protruding from the interior wall surface of the holding portions.

7. The right-angle electrical connector according to claim 4, wherein the protrusions of the blades are abuttable against the rear faces of the guiding portions at locations corresponding to said guiding portions in the array direction.

* * * * *